US006148166A

United States Patent [19]

Watanabe

[11] Patent Number: 6,148,166

[45] Date of Patent: Nov. 14, 2000

[54] IMAGE FORMING APPARATUS FOR FORMING IMAGES WITH LIQUID DEVELOPER

[75] Inventor: Mitsuyoshi Watanabe, Nagoya, Japan

[73] Assignee: Brother Kogyo Kabushiki Kaisha, Nagoya, Japan

[21] Appl. No.: 09/384,229

[22] Filed: Aug. 27, 1999

[30] Foreign Application Priority Data

Aug. 28, 1998 [JP] Japan ..... 10-244088

[51] Int. Cl.[7] ..... G03G 15/10

[52] U.S. Cl. ..... 399/239

[58] Field of Search ..... 399/233, 237, 399/239, 238, 244

[56] References Cited

U.S. PATENT DOCUMENTS

| | | | |
|---|---|---|---|
| 3,096,198 | 7/1963 | Schaffert . | |
| 3,570,456 | 3/1971 | Marlor et al. . | |
| 3,830,199 | 8/1974 | Saito et al. . | |
| 3,894,512 | 7/1975 | Ohno | 399/238 |
| 3,973,955 | 8/1976 | Ohno et al. . | |
| 3,974,554 | 8/1976 | Fantuzzo . | |
| 3,978,817 | 9/1976 | Hauser et al. . | |
| 3,991,711 | 11/1976 | Nakano et al. | 399/239 X |
| 4,043,657 | 8/1977 | Karnik . | |
| 4,050,804 | 9/1977 | Silverberg . | |
| 4,058,637 | 11/1977 | Ohno | 399/237 X |
| 4,133,292 | 1/1979 | Takasugi et al. | 399/244 |
| 4,258,115 | 3/1981 | Magome et al. . | |
| 4,493,550 | 1/1985 | Takekida . | |
| 4,990,962 | 2/1991 | Kishi . | |
| 5,424,813 | 6/1995 | Schlueter, Jr. et al. . | |
| 6,035,165 | 3/2000 | Watanabe | 399/239 |
| 6,035,166 | 3/2000 | Furukawa | 399/239 |

FOREIGN PATENT DOCUMENTS

| | | |
|---|---|---|
| 52-6091 | 2/1977 | Japan . |
| 55-18906 | 5/1980 | Japan . |
| 62-5282 | 1/1987 | Japan . |
| 1-20740 | 4/1989 | Japan . |
| 1-40985 | 9/1989 | Japan . |

*Primary Examiner*—Susan S. Y. Lee
*Attorney, Agent, or Firm*—Oliff & Berridge, PLC

[57] ABSTRACT

The image forming apparatus is provided with: a developer retainer formed with a number of fine through-holes retaining liquid developer; and a photosensitive drum that forms images thereon. The photosensitive drum is formed with an electrically-charged latent image on its surface. When the liquid developer retained in the developer retainer approaches the latent image, the liquid surface of the liquid developer is attracted toward the photosensitive drum surface, by the electric field, at regions where the positively-charged latent image exists. As a result, the liquid developer adheres to the latent image. At regions where no latent image is formed, due to the wettability of the mesh wall with respect to the liquid developer, the liquid level is maintained as being fixed. Accordingly, the liquid developer does not adhere to the portion where no latent image is formed. The adhesion of the liquid developer only onto the portion where the latent image is formed develops the latent image into a visible image.

29 Claims, 22 Drawing Sheets

IMAGE FORMING APPARATUS FOR FORMING IMAGES WITH LIQUID DEVELOPER

BACKGROUND OF THE INVENTION

1. Field of the Invention

The present invention relates to an image forming apparatus which develops highly fine images with liquid developer.

2. Description of Related Art

Heretofore, image forming apparatuses of a type that use liquid developer generally use the method of causing electrical migration of toner fine particles which are dispersed in an insulating liquid carrier such as aliphatic saturated hydrocarbon or the like, so that the toner fine particles adhere to the surface of a dielectric body on which an electostatic latent image is formed. This method enables the use of toner particles with smaller diameter than powder toner which is used in a developing device, and it is suitable for producing an image of a high resolution. This method is also advantageous that liquid toner needs less energy for fixing than powder toner. However, aliphatic saturated hydrocarbon used as liquid carrier generates a disagreeable smell. When the aliphatic saturated hydrocarbon is used, there is a concern for fires. Drying process is needed after images are formed by the aliphatic saturated hydrocarbon. Accordingly, the aliphatic saturated hydrocarbon is unsuitable for use in offices and homes.

Japanese Patent Publication No. 55-18906 has proposed another type of image developing device that uses liquid developer. According to the image developing device, a developer retainer is located in confrontation with and close to a latent image-forming body (photoconductive body). The surface of the latent image forming body is not immersed with liquid developer, but aqueous liquid developer is retained in the developer retainer. The developer retainer has a two-layered structure comprised from a hydrophilic layer and a water repellent layer. The water repellent layer presents a contact angle more than 90 degrees with respect to the liquid developer. The developer retainer is located such that the water repellent layer confronts the latent image-forming body. The developer retainer is formed with a number of fine through-holes. Each fine through-hole passes through both of the hydrophilic layer and the water repellent layer. The liquid developer is supplied into the fine through-holes from their open ends on the hydrophilic layer side. The liquid developer is retained in the fine through-holes because the liquid developer cannot enter the water-repellent portion due to the water-repellent property thereof. When an electrostatic latent image is formed on the latent image-forming body, the liquid developer is selectively attracted electrostatically toward the latent image-bearing body. As a result, the liquid developer advances or moves forward in the through-holes along their inner wall surfaces to enter the water-repellent portion. The liquid developer finally reaches the surface of the latent image-forming body, and adheres to the electrostatic latent image. Thus, the liquid developer develops the latent image into a visible image.

The above-described image developing device does not suffer from any disagreeable smell. The image developing device can be safely used without any fear of fires. The image developing device does not need drying processes after image formation.

SUMMARY OF THE INVENTION

In the above-described conventional image developing device, however, each fine through-hole has a cylindrical shape whose diameter is uniform over the entire length from its developer supply side to its latent image-forming body side. The level of the surface of the liquid developer retained in each through-hole is controlled merely by adjusting the water repellent property of the water repellent portion. Accordingly, if the water repellent property of the water repellent layer is degraded due to contamination or the like, the contact angle at the water repellent layer will possibly decrease lower than 90 degrees. As a result, even when no latent image is formed on the latent image-forming body, the liquid developer will erroneously advance in the through-holes and enter the water repellent portion. The liquid developer will reach the open ends of the through-holes on the latent-image forming body side. In this case, accurate image development will become impossible.

In the liquid developer retainer, liquid developer advances, according to an electrocapillary action, along the inner side surfaces of the through-holes before reaching the latent image. The distance between the surface of the liquid developer retained in the developer retainer and the latent image formed on the latent image-forming body greatly affects the amount of the electrostatic force that attracts the liquid developer to the latent image-forming body. If the distance between the liquid surface and the latent image is too large, the liquid developer will not move to adhere to the latent image. On the other hand, if the liquid surface is contacted with the latent image, the liquid developer will spread widely between the surface of the developer retainer and the latent image. It becomes difficult to stably perform image development operation.

It is therefore an objective of the present invention to overcome the above-described problems and to provide an improved image forming apparatus that can stably maintain the level of the liquid developer retained in the fine through-holes while precisely controlling the distance between the liquid surface level and the latent image. thereby reliably forming highly-fine images.

In order to attain the above and other objects, the present invention provides an image forming apparatus for forming images, the apparatus comprising: an image bearing body having a surface bearing a latent image thereon; a developer retainer located in confrontation with the image bearing body, the developer retainer having a first surface opposed to the first surface, the developer retainer including a number of partition walls for defining a number of through-holes, each partition wall partitioning a corresponding through-hole from its adjacent through-hole, each partition wall extending in a predetermined direction from the second surface to the first surface, thereby allowing the corresponding through-hole to extend in the predetermined direction along the partition wall and to be opened on both of the first and second surfaces, each partition wall having a shape that allows an area of a cross-section of the corresponding through-hole to change along the predetermined direction, the cross-section being defined normal to the predetermined direction; and a developer supply member that supplies a liquid developer to the developer retainer from the second surface, thereby allowing the liquid developer to be held in the developer retainer in a state covering the second surface and to be selectively supplied to the image bearing body via the through-holes to develop the latent image into a visible image.

The liquid developer is preferably held in the developer retainer to have a first liquid surface that confronts the image bearing body, the first liquid surface being maintained in the developer retainer at a position that is determined dependently both on the shape of each partition wall and on wettability of the partition wall with respect to the liquid developer. The liquid developer is preferably held in the developer retainer to have a second liquid surface that is opposed to the first liquid surface, the second liquid surface being provided at an interface between the liquid developer and the developer supply member.

Because the cross-sectional area of the through-hole changes according to its position along the predetermined direction, it is possible to control the level of the liquid developer to its energy-stable position. It therefore becomes possible to produce highly-fine images by maintaining the distance between the latent image and the liquid level.

Each partition wall has a surface exposed to the corresponding through-hole. Each partition wall may preferably have, on its surface, an angle changing portion in which an angle, which is defined between the surface of the partition wall and the cross-section of the corresponding through-hole with respect to a direction opposite to the predetermined direction, decreases along the predetermined direction from a value that is greater than a contact angle, which is determined dependently on material of the partition wall and which is indicative of the wettability of the surface of the partition wall with respect to the liquid developer, toward another value that is smaller than the contact angle, the first liquid surface of the liquid developer being maintained at a position on the surface of each partition wall where the angle is equal to the contact angle. The level of liquid developer is maintained at a position where the angle between the partition wall surface and the cross-section of the through-hole is equal to the contact angle. The contact angle is determined dependent on the wettability of the wall surface with respect to the liquid developer. It therefore becomes possible to produce highly-fine images by maintaining fixed the distance between the liquid level and the latent image on the image-bearing body.

The angle changing portion may include an edge portion, at which the angle greatly changes from the value greater than the contact angle, through the contact angle, toward the other value smaller than the contact angle. In this case, there is limited only a small region where the angle between the partition wall surface and the through-hole cross-section is equal to or close to the contact angle. It is therefore possible to maintain the liquid level very stably. It is possible to maintain fixed the distance between the liquid level and the latent image on the image-bearing body with high precision.

BRIEF DESCRIPTION OF THE DRAWINGS

The above and other objects, features and advantages of the invention will become more apparent from reading the following description of the preferred embodiment taken in connection with the accompanying drawings in which:

FIG. 2(*b*) is a cross-sectional view of the developer supply drum taken along a line IIb—IIb in FIG. 2(*a*);

FIG. 2(*c*) is a cross-sectional view of the developer supply drum taken along a line IIc—IIc in FIG. 2(*a*);

FIG. 2(*d*) is a cross-sectional view of a cylindrical core in the developer supply drum of FIG. 2(*c*), on which a developer supply porous member, a developer storage porous member, or a developer retainer is not yet mounted;

FIG. 3(*b*) is a cross-sectional view taken along a line IIIb—IIIb of FIG. 3(*a*);

FIG. 5(*b*) illustrates a forward contact angle and a rearward contact angle defined for a liquid located on a solid body;

FIG. 7(*b*) is a schematical view illustrating the relationship between respective positions on the surface of the wall of FIG. 7(*a*) and an angle θ defined between the wall surface and a cross-sectional plane of the through-hole;

FIG. 7(*c*) is a graph showing the relationship of FIG. 7(*b*);

FIG. 8(*b*) is a schematical view illustrating the relationship between respective positions on the surface of the wall of FIG. 8(*a*) and an angle θ defined between the wall surface and a cross-sectional plane of the through-hole;

FIG. 8(*c*) is a graph showing the relationship of FIG. 8(*b*);

FIG. 9(*b*) is a schematical view illustrating the relationship between respective positions on the surface of the wall of FIG. 9(*a*) and an angle θ defined between the wall surface and a cross-sectional plane of the through-hole;

FIG. 9(*c*) is a graph showing the relationship of FIG. 9(*b*);

FIG. 10(*b*) is a schematical view illustrating the relationship between respective positions on the surface of the wall of FIG. 10(*a*) and an angle θ defined between the wall surface and a cross-sectional plane of the through-hole;

FIG. 10(*c*) is a graph showing the relationship of FIG. 10(*b*);

DETAILED DESCRIPTION OF THE PREFERRED EMBODIMENT

Figure 1:
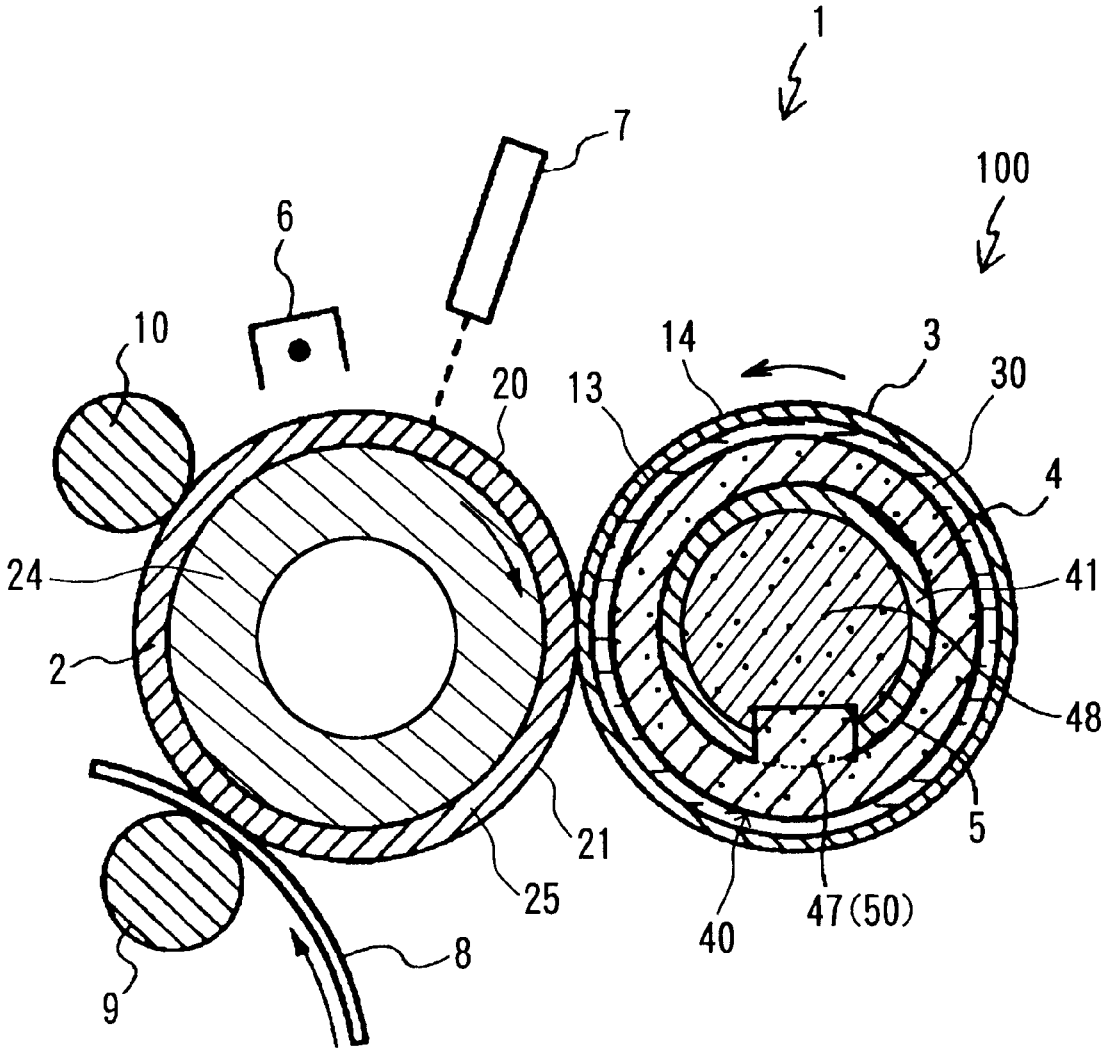
FIG. 1 is a view schematically showing a structure of an image forming apparatus according to a preferred embodiment of the present invention.

An image forming apparatus according to a preferred embodiment of the present invention will be described while referring to the accompanying drawings wherein like parts and components are designated by the same reference numerals to avoid duplicating description.

As shown in FIG. 1, an image forming apparatus 1 of the present embodiment is mainly provided with: a photosensitive drum 2; a charging device 6; a selective exposure device 7; a developer supply drum 100; a transfer roller 9; and a cleaning roller 10. The photosensitive drum 2 is for bearing thereon an electrostatic latent image 20. The charging device 6, disposed near the photosensitive drum 2, is for uniformly electrically charging an outer surface 21 of the photosensitive drum 2. The selective exposure device 7 is for selectively exposing the outer surface 21 of the photosensitive drum 2 to light in accordance with image data, thereby forming a desired electrostatic latent image 20 on the drum surface 21.

The developer supply drum 100 is of a cylindrical shape and is disposed opposite to the photosensitive drum 2 so as to be rotatable with its outer surface 14 being in contact with the outer surface 21 of the photosensitive drum 2. The developer supply drum 100 is for selectively supplying liquid developer 30 to the photosensitive drum 2, thereby developing the electrostatic latent image 20 into a visible image. As will be described later, the developer supply drum 100 has an integral structure comprised from a cylindrical-shaped developer supply member 40 surrounded by a roll-shaped developer retainer 3.

The transfer roller 9 is for transferring the developed image from the drum surface 21 onto a recording paper 8. The cleaning roller 10 is for cleaning the surface 21 of the photosensitive drum 2 to remove remaining developer therefrom.

As liquid developer 30 for use in the image forming apparatus 1, aqueous/conductive liquid obtained by dissolving or dispersing a coloring component such as dye or pigment in pure water can be used. About $10^5$ Ωcm or less is sufficient for the conductivity of the liquid developer 30. Although the specification of the apparatus 1 does not limit the liquid developer 30 to the aqueous one, the aqueous liquid developer is preferable in consideration of an environmental problem and a manufacturing cost. In the image forming apparatus 1 of this example, therefore, the aqueous solution is used as the liquid developer 30. The liquid developer 30 therefore has an environmental advantage concerning smell or the like, an industrial advantage concerning inexpensive material cost, and a safety advantage concerning possibility of fire generation. That is, the liquid developer 30 generates no disagreeable smell. The liquid developer 30 can be safely used without an fear of fires. The liquid developer 30 can be produced at low cost.

The image forming apparatus 1 does not need any thermal fixing device which is required in a conventional electrophotographic type image forming apparatus that uses powder toner. Accordingly, the image forming apparatus 1 of the present embodiment is advantageous in low consumption of power and in compact size. Using the liquid developer 30, it is possible to reproduce many gradations in natural picture images with high reproducibility.

Next, each component of the image forming apparatus 1 will be described in greater detail.

The photosensitive drum 2 is comprised from: a hollow cylindrical sleeve 24; and a photoconductive layer 25 provided over the outer periphery of the cylindrical sleeve 24. The photoconductive layer 25 is preferably made of a material that can retain an electrostatic latent image on its outer surface 21. The material of the photoconductive layer 25 is preferably selected so that the surface of the photoconductive layer 25 will have wettability to the liquid developer 30 higher than the wettability of the developer retainer 3 in the developer supply drum 100. It is noted, however, that if the wettability of the photoconductive layer 25 is too high, the deposit of the liquid developer 30 will cause the droplet of the liquid developer 30 to be spread over the photoconductive layer 25 and thus distorting the developed image. Therefore, the photoconductive layer 25 is preferably made of a material whose wettability defines its contact angle G in a range of about 30 degrees to about 80 degrees.

In the present embodiment, an organic photoconductive material (OPC) used in general laser printers is selected as the material of the photoconductive layer 25. It is noted that there are two types of organic photoconductor: a laminated-layered OPC of a negative-charge type; and a single-layered OPC of a positive-charge type. Though relatively many printers employ the laminated-layered OPC of the negative-charge type, the image forming apparatus 1 of the present embodiment employs the single-layered OPC of the positive-charge type for the photoconductive layer 25. The single-layered OPC is comprised from a base made of polycarbonate resin in which derivative of perylene tetra carboxylic acid di-imide (perylene pigment) is dispersed as a charge generating material (CGM).

The charging device 6 is comprised from, for example, a Scorotron charger which is used in general laser printers. A charging potential of the charging device 6 can be set to about 400 volts to 600 volts.

The selective exposure device 7 is comprised from a photo-scanner that includes a semiconductor laser and a polygon mirror. The photo-scanner performs modulation of the laser beam intensity in accordance with image data while scanning the laser beam on the surface of the photosensitive drum 2 that is electrically charged by the charging device 6, thereby forming an electrostatic latent image 20 on the drum surface 21.

Next, the developer supply drum 100 will be described below with reference to FIGS. 1 through 3(*b*).

Figure 2:
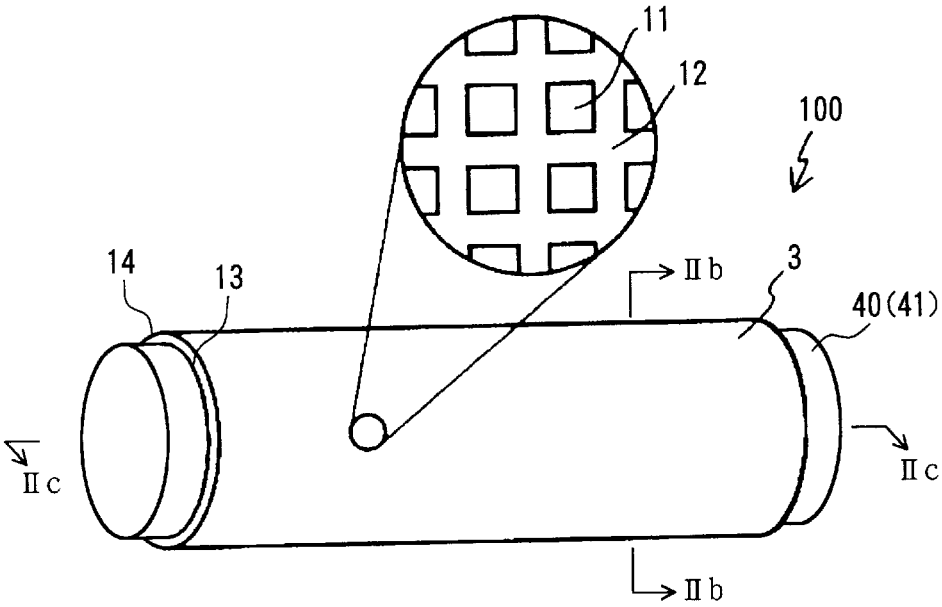
FIG. 2(*a*) is an external perspective view of a developer supply drum in the image forming apparatus of FIG. 1.
Figure 2:
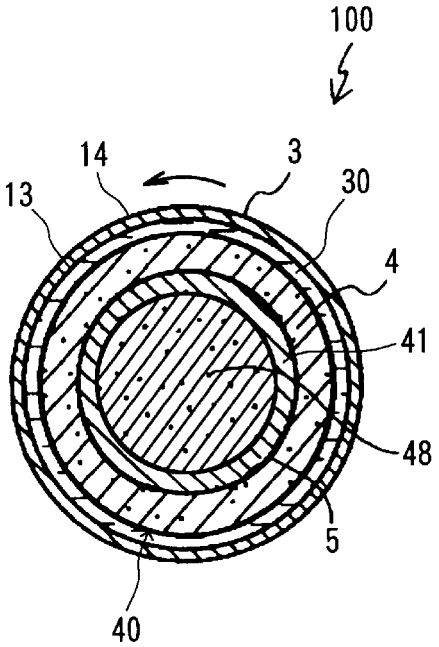
Figure 2:
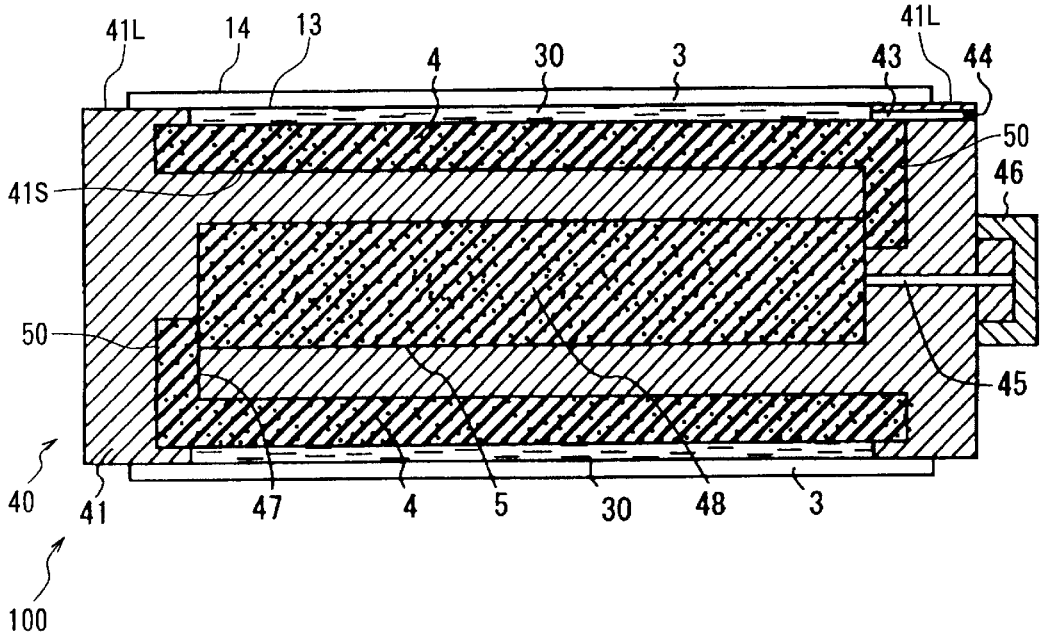
Figure 2:
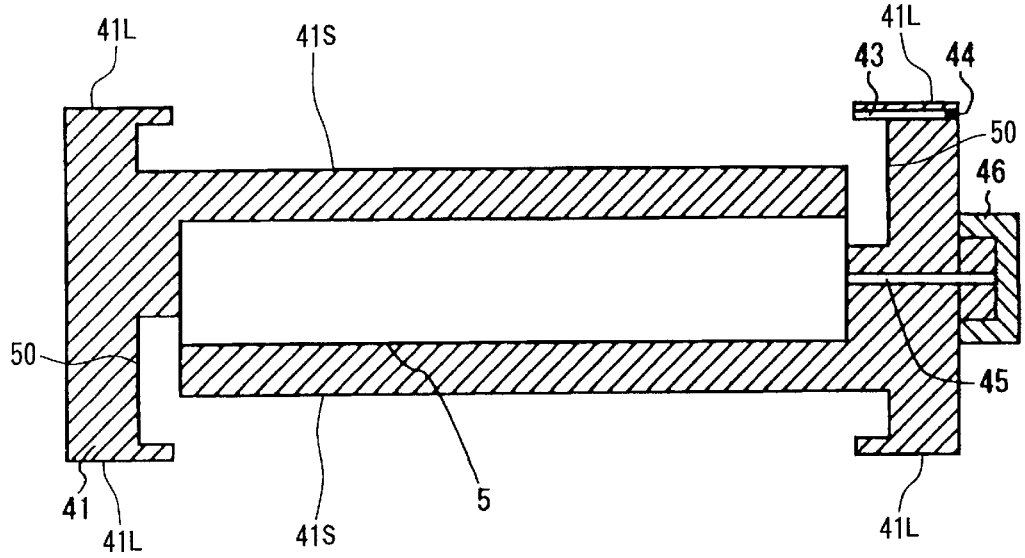
Figure 3:
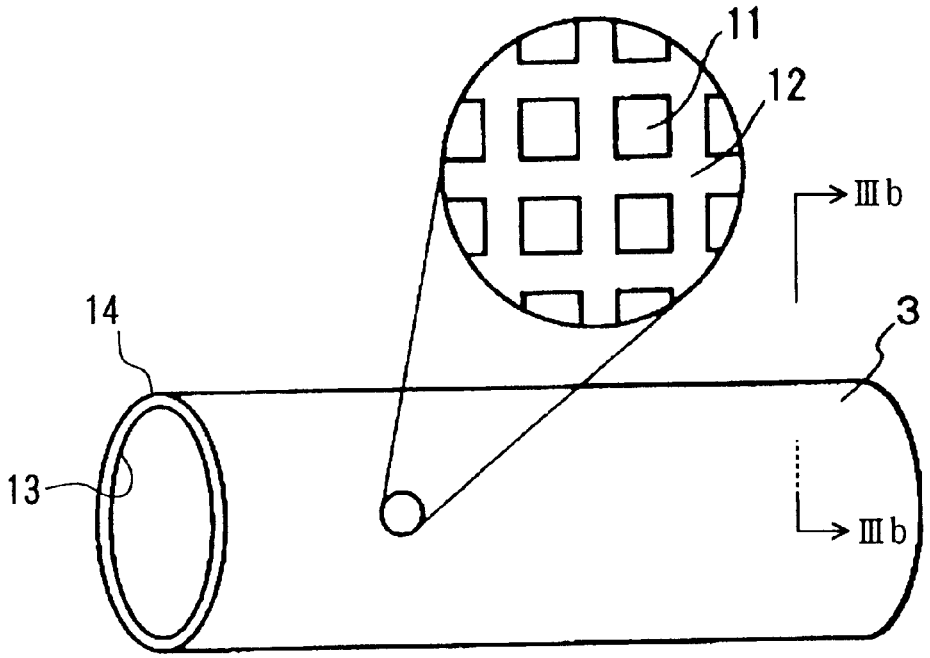
FIG. 3(*a*) is an external perspective view schematically showing a developer retainer provided in the developer supply drum, with an enlarged view of a part of a surface of the developer retainer.
Figure 3:
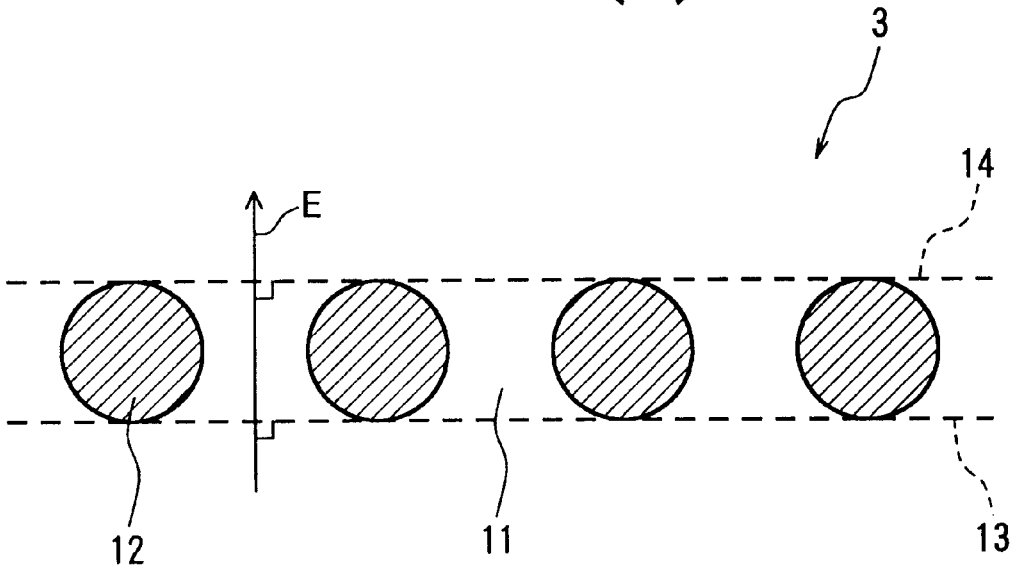

As shown in FIG. 2(*a*), the developer supply drum 100 has an integral structure comprised from the cylindrical-shaped developer supply member 40 surrounded by the roll-shaped developer retainer 3.

The developer supply member 40 is for storing the liquid developer 30 and for continuously supplying the liquid developer 30 to the developer retainer 3. The developer retainer 3 is for receiving the liquid developer 30 from the developer supply member 40 and for allowing the liquid developer 30 to selectively adhere to the surface 21 of the photosensitive drum 2.

As apparent from FIGS. 2(*a*) through 2(*c*), the developer supply member 40 is of a cylindrical shape. The developer retainer 3 is of a roll shape (or cylindrical hollow shape) that has an inner surface 13 and an outer surface 14. The developer supply member 40 and the developer retainer 3 are assembled together into the integrated structure 100 in a manner that the developer retainer 3 concentrically surrounds the developer supply member 40. Thus, in the integrated structure 100, the developer supply member 40 is disposed inside the roll-shaped developer retainer 3 while confronting the inner surface 13 of the developer retainer 3. Because the developer retainer 3 is fixedly attached to the developer supply member 40 as will be described later, the developer retainer 3 and the developer supply member 40 rotate together with the outer surface 14 being in contact with the photosensitive drum 2.

The developer supply member 40 will be described below in greater detail.

As shown in FIGS. 2(*a*) through 2(*c*), the developer supply member 40 is comprised from a core 41 substantially of a cylindrical shape. A developer tank 5 is formed inside the cylindrical core 41 for storing liquid developer 30 therein. A developer supply porous (foam) member 4 is fitted to the outer periphery of the cylindrical core 41 in such a manner that the developer supply porous member 4 is in fluid communication with the developer tank 5 so as to be supplied with liquid developer 30 from the developer tank 5.

The roll-shaped developer retainer 3 is provided surrounding the outer periphery of the developer supply member 40 in confrontation with but out of contact with the developer supply porous member 4. Thus, the roll-shaped developer retainer 3 is provided concentrically with the developer supply member 40.

More specifically, as shown in FIG. 2(*d*), the cylindrical core 41 has a small diameter portion 41S at its middle area along its axial direction, and has a pair of large diameter portions 41L. 41L at its both end areas along the axial direction. The developer tank 5 of a hollow cavity shape is formed inside the cylindrical core 41 to extend along the axis of the cylindrical core 41. A pair of slits 50 are formed inside the cylindrical core 41 so as to extend radially outwardly from the developer tank 5 at its both ends. The slits 50 are opened on the outer peripheral surface of the cylindrical core 41 at its small diameter portion 41S.

As shown in FIGS. 2(*b*) and 2(*c*), a developer storage porous (foam) member 48 is provided in the entire cavity of the developer tank 5. The developer storage porous member 48 is made from a sponge substantially of a cylindrical shape. The developer storage porous member 48 is saturated or impregnated with liquid developer 30.

The developer supply porous member 4 is made from a sponge substantially of a roll shape. A pair of contact portions 47 extend radially inwardly from the roll-shaped sponge 4 at its both ends. The roll-shaped sponge 4 is fitted to the outer periphery of the cylindrical core 41 at the small diameter portion 41S with each contact portion 47 being inserted into the corresponding slit 50 to contact the developer storage porous member 48 in the developer tank 5. With this arrangement, liquid developer 30 can be supplied via the contact portions 47 from the developer storage porous member 48 to the entire portion of the developer supply porous member 4. Thus, the developer supply porous member 4 can be saturated or impregnated with liquid developer 30, and serves to supply the liquid developer 30 to the developer retainer 3.

It is noted that the developer tank 5 is preferably airtight except at the slits 50 where the sponge contact portions 47 are inserted.

The roll-shaped developer retainer 3 is provided surrounding the cylindrical core 41 in such a manner that both longitudinal ends of the roll 3 are attached to the outer periphery of the cylindrical core 41 at its large diameter portions 41L. Accordingly, a gap is formed between the developer retainer 3 and the developer supply porous member 4. The gap corresponds to the amount that the large-diameter portions 41L protrudes radially outwardly from the developer supply porous member 4 that is fitted to the small-diameter portion 41S. Accordingly, the gap is maintained as fixed. For example, the gap is set to about 1 to 2 mm.

The cylindrical core 41 is further formed with a developer introduction tube 43 for supplying liquid developer 30 to the gap between the developer supply porous member 4 and the developer retainer 3. A plug 44 is provided to an open end of the developer introduction tube 43. The core 41 is also formed with a central supply tube 45 that extends along the central axis of the cylindrical core 41 and whose open end is covered with a cap member 46.

With this structure, at the initial stage of usage, liquid developer 30 is introduced from the developer introduction tube 43 into the gap between the developer supply porous member 4 and the developer retainer 3. Thus, liquid developer 30 is sufficiently supplied into the gap between the developer supply porous member 4 and the developer retainer 3. After this initial supply of liquid developer 30, the introduction tube 43 is closed with the plug 44. During usage, in order to constantly supply a sufficient amount of liquid developer to the gap between the developer supply porous member 4 and the developer retainer 3, the liquid developer 30 is repeatedly supplied to the developer storage porous member 48 via the central supply tube 45. After completion of this liquid developer supplying operation, the supply tube 45 is covered with the cap member 46.

The developer retainer 3 will be described below in greater detail with reference to FIGS. 3(*a*) and 3(*b*).

The developer retainer 3 is for retaining liquid developer 30 which is supplied from the liquid developer supply member 40. The developer retainer 3 is also for selectively supplying the liquid developer 30 to the surface 21 of the photosensitive drum 2. The developer retainer 3 is made from a mesh sheet of a roll-shape. The roll-shaped mesh sheet 3 is made from a thin metal plate of nickel, copper, or the like, and is formed with many fine through-holes 11. In this example, the mesh sheet 3 is made from nickel. As shown in FIG. 3(*b*), each fine through-hole 11 extends in a direction E normally to the outer and inner side surfaces 13 and 14, and passes through the mesh sheet 3 to be opened on both side surfaces 13 and 14. In other words, the developer retainer 3 is formed from metallic walls 12 that partition the through-holes 11. Each wall 12 partitions a corresponding through-hole 11 from its adjacent through-hole 11. The walls 12 also define the inner and outer side surfaces 13 and 14 of the mesh sheet 3. In this example, each wall 12 has a circular-shaped cross-section as shown in FIG. 3(*b*).

The developer retainer 3 with the above-described structure can be formed by shaping a finely-pitched mesh sheet into a roll, for example. The developer retainer 3 is not limited to a roller-shaped one but can be also a belt-shaped one, for example. As the mesh sheet, the one for a highly fine screen print can be used. The mesh having 200 lines or more per one inch is suitable for the highly fine image formation. It is noted that liquid developer 30 for forming one dot of image is retained in one fine through-hole 11 in the developer retainer mesh 3. Accordingly, as the mesh is more finely pitched, the mesh can be used for the more highly fine image formation.

It is noted that a metallic mesh manufactured by electroforming has no weave pattern and can be a uniform/highly-fine mesh of a high rate of opening. That is, the electroforming allows the mesh of 2,000 lines or more to be manufactured. Accordingly, the metallic mesh produced through the electroforming process is suitable for the formation of the developer retainer 3. One example of the electroforming process to manufacture a fine mesh sheet is described in Japanese Patent publication No. 1-20740, for example. According to the present embodiment, the mesh sheet of the developer retainer 3 is produced as will be described later. Copper, nickel, or the like can be used as the material constituting this mesh sheet.

Figure 4:
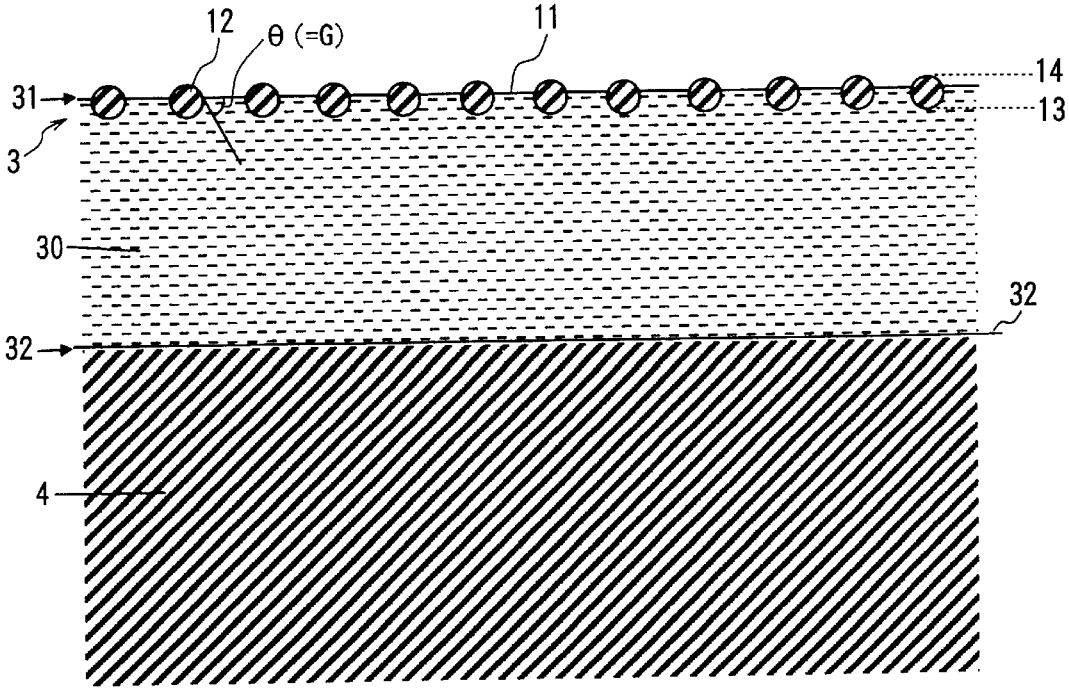
FIG. 4 is schematically illustrates the state how liquid developer is retained in the developer retainer.

With the above-described structure, the developer retainer 3 retains liquid developer 30 therein as shown in FIG. 4 in a state described below.

It is noted that the liquid developer 30 is supplied to the developer retainer 3 from the developer supply porous member 4. Because the developer supply porous member 4 is located confronting the inner side surface 13 of the roll-shaped developer retainer 3, the liquid developer 30 is supplied to the developer retainer 3 from its inner side surface 13. The liquid developer 30 is therefore held in the developer retainer 3, while fully covering the inner side surface 13 of the developer retainer 3. More specifically, when supplied from the developer supply porous member 4, the liquid developer 30 adheres, due to its own adhesive force, to the inner side surface 13 of the developer retainer 3. According to this example, as will be described later, a part of the liquid developer further enters the through-holes 11 of the developer retainer 3. The part of the liquid developer 30 thus retained in each through-hole 11 is connected with one another via the remaining part of the liquid developer 30 that is adhered to the inner surface 13 of the developer retainer 3. Thus, the liquid developer 30 is integrally retained in the developer retainer 3 as shown in FIG. 4.

Thus, the liquid developer 30 is held in the developer retainer 3 in such a manner that the liquid developer 30 will have both an outer liquid surface 31 that confronts the photosensitive drum 2 and an inner liquid surface 32 that confronts the outer surface of the developer supply porous member 4. Both liquid surfaces 31 and 32 serve as free surfaces with respect to pressure applied thereto. In this example, the outer liquid surface 31 is positioned in the through-holes 11, that is, between the inner and outer surfaces 13 and 14 of the developer retainer 3. The inner liquid surface 32 is positioned on the outer surface of the developer supply porous member 4.

Mechanism how the outer and inner liquid surfaces 31 and 32 are positioned as shown in FIG. 4 will be described below in greater detail.

It is noted that the diameter of the through-holes 11 is several ten micrometers and that the thickness of the developer retainer 3, i.e., a distance between the outer and inner side surfaces 13 and 14, is also several ten micrometers. In this example, the hole diameter of the through-hole 11 is about 40 $\mu$m, and the thickness of the developer retainer 3 is about 20 $\mu$m. Accordingly, effects from gravitational forces are very small and are negligible. The liquid developer 30 retained in the developer retainer 3 therefore acts mainly according to its surface tension. Thus, the liquid surfaces 31 and 32 will become stable at those levels that make minimum the total amount of the surface energies in the liquid developer 30. Accordingly, the inner liquid surface 32 is maintained stable on the outer surface of the developer supply porous member 4. The inner liquid surface 32 therefore serves as a boundary between the liquid developer 30 and the developer supply porous member 4. The liquid developer 30 therefore covers the inner side surface 13 of the developer retainer 3 and forms the undivided, integral free surface 32. The surface energy at the inner liquid surface 32 is therefore always maintained as being fixed.

In such a state, the liquid developer 30 will gradually enter the through-holes 11 to move its outer liquid surface 31 in a direction toward the outer side surface 14 until the outer liquid surface 31 reaches such a level that makes minimum the total amount of its surface energy. At such a level, the outer liquid surface 31 will become planar. More specifically, the liquid developer 30 will gradually enter the through-holes 11 to move its outer liquid surface 31 toward the outer side surface 14 if an angle $\theta$, defined between the surface of the metal wall 12 and the outer liquid surface 31, is greater than a contact angle G that is indicative of wettability of the metal wall 12 with respect to the liquid developer 30. In other words, the liquid developer 30 will continue advancing in the through-holes 11 along the surfaces of the mesh walls 12 until the angle $\theta$ formed between the metal wall surface 12 and the outer liquid surface 31 becomes equal to or less than the contact angle G.

The contact angle G will be described below in greater detail.

The contact angle G is determined dependently on the material forming the walls 12, and is indicative of the wettability of the wall-forming material. For example, when the walls 12 are made of nickel, the walls 12 have the contact angle G of about 60 degrees. When the walls 12 are made of copper, the walls 12 have the contact angle G of less than 60 degrees.

Figure 5:
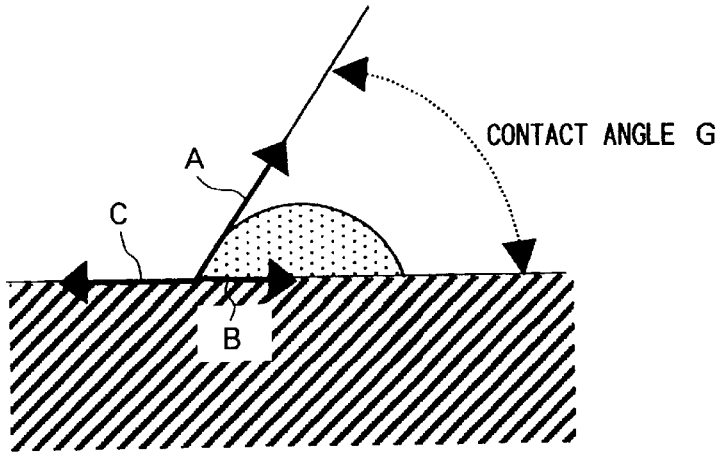
FIG. 5(*a*) illustrates a contact angle defined for a liquid located on a solid body.
Figure 5:
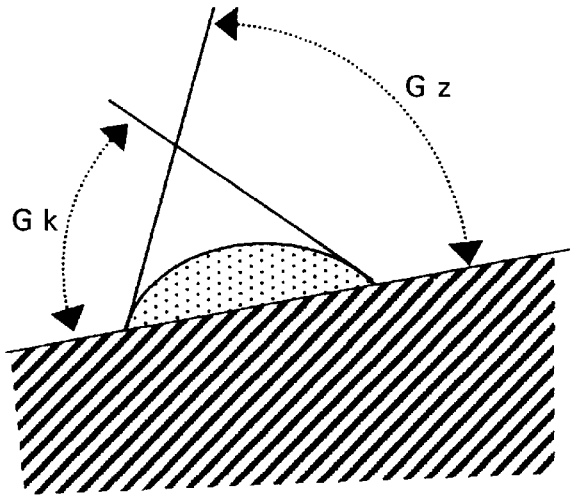

Generally, when liquid is located on the surface of a solid body, the liquid is in a stable condition as shown in FIG. 5(*a*), with the contact angle G being formed between the liquid surface and the solid body surface. The amount of the contact angle "G" represents wettability of the solid body surface with respect to the liquid.

According to a predetermined Young-Deple formula, the contact angle "G", liquid surface energy "A" (generally referred to as "surface tension"), interface energy "B" between the liquid and the solid body, and solid body surface energy "C" satisfy the following equation (1):

$$C=A\cos G+B \quad (1)$$

It is noted that the contact angle G is not fixed even for the combination of the same solid body and of the same liquid. The contact angle G can change between a forward contact angle Gz and a rearward contact angle Gk. When a liquid body advances forward to spread along the solid body surface, the liquid body has the forward contact angle Gz at its front side surface. On the other hand, when a liquid body recesses to contract along the solid body surface, the liquid body has the rearward contact angle Gk at its rear side surface. The forward contact angle Gz and the rearward contact angle Gk can be defined as shown in FIG. 5(*b*), for example, when the interface between the solid body and the liquid body is slanted and therefore the liquid is to move along the solid body surface slantedly downwardly. In this case, the forward contact angle Gz is defined as an angle formed between the front side surface of the liquid body and the solid body surface. The rearward contact angle Gk is defined as an angle formed between the rear side surface of the liquid body and the solid body surface. As apparent from the figure, the forward contact angle Gz is greater than the rearward contact angle Gk. For example, the forward contact angle Gz for nickel with respect to pure water is about 80 degrees, and the rearward contact angle Gk for nickel with respect to pure water is about 60 degrees. It is noted that the values of both of the forward and rearward contact angles change according to the surface roughness of the solid body (nickel, in this case) and according to the degree how the solid body has been washed. The values of both of the forward and rearward contact angles change also with respect to the kind of liquid.

In an actual condition, the contact angle G can change between the values of the rearward contact angle Gk and of the forward contact angle Gz. This is because the amount of the solid body surface energy "C" in the formula (1) changes even when a very thin liquid film exists on the solid body surface. The contact angle G presents the amount of the forward contact angle Gz when no liquid film exists on the solid body surface. The contact angle G presents the amount of the rearward contact angle Gk when some liquid film exists on the solid body surface. In an actual condition, according to the actual amount of the solid body surface energy "C" indicative of the state whether and how a liquid film exists on the solid body surface, the contact angle G presents some value that falls in a range between the forward contact angle Gz and the rearward contact angle Gk.

According to the present embodiment, while the image forming apparatus 1 is driven to perform its image forming operation, the outer liquid surface 31 repeatedly moves outwardly and inwardly in the developer retainer 3 along the surfaces of the metal walls 12. The liquid developer 30 repeatedly reaches the surface 21 of the photosensitive drum 2 and then retreats away from the photosensitive drum surface 21. Once the surface of the metal wall 12 is wet, the amount of the contact angle G for the metal wall 12 becomes equal to that of the rearward contact angle Gk.

On the other hand, when the image forming operation is stopped and a certain amount of time has elapsed thereafter, an outer side portion of the metal wall surface 12 that is outside from the outer liquid surface 31 will be dried. In this case, the metal walls 12 will present the contact angle G whose amount is equal to that of the forward contact angle Gz. Thus, it is preferable to consider the actual condition of the metal wall surface 12 and to set the amount of the contact angle G to some value in the range between the forward contact angle Gz and the rearward contact angle Gk. In the following description, considering the actual condition of the metal walls 12 during the image forming operation, the contact angle G is considered to have the amount equal to that of the rearward contact angle Gk.

According to the present embodiment, the cross-sectional shape of each wall 12 is designed dependently on the amount of the contact angle G of the wall 12, to thereby precisely control the outer liquid surface 31 of the liquid developer 30 to be positioned at a proper level in the through-holes 11.

Figure 6:
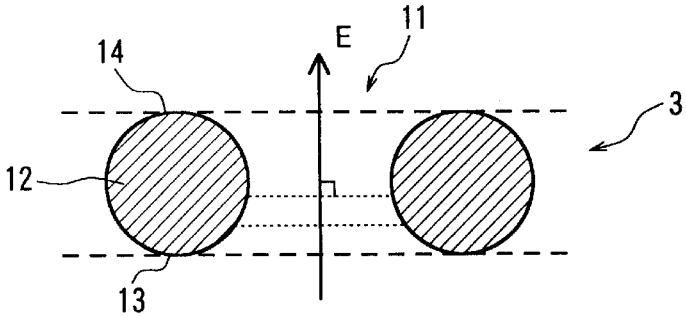
FIG. 6 schematically shows the state how walls of the developer retainer have circular cross-sections and define through-holes.

More specifically, according to this example, as shown in FIG. 6, each wall 12 of the developer retainer 3 has substantially a circular cross-section. Accordingly, a hole diameter of each through-hole 11 changes in its extending direction E. That is, the hole diameter is the smallest in the middle of the through-hole 11 in its extending directing E and gradually increases in directions toward both of the inner and outer surfaces 13 and 14. In other words, the cross-sectional area of each through-hole 11 that is defined normal to the through-hole extending direction E changes along the through-hole extending direction E.

Figure 7:
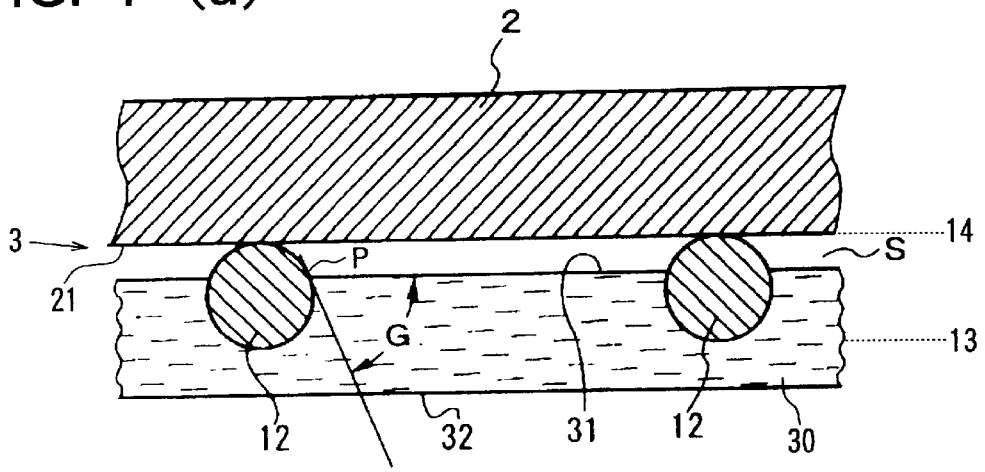
FIG. 7(*a*) schematically shows the state how liquid developer is retained in the developer retainer whose constituent wall has the circular cross-section.
Figure 7:
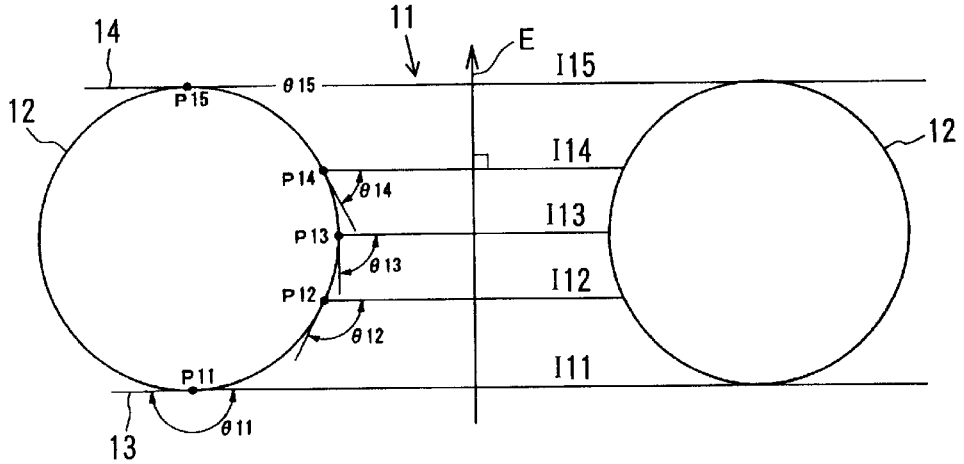
Figure 7:
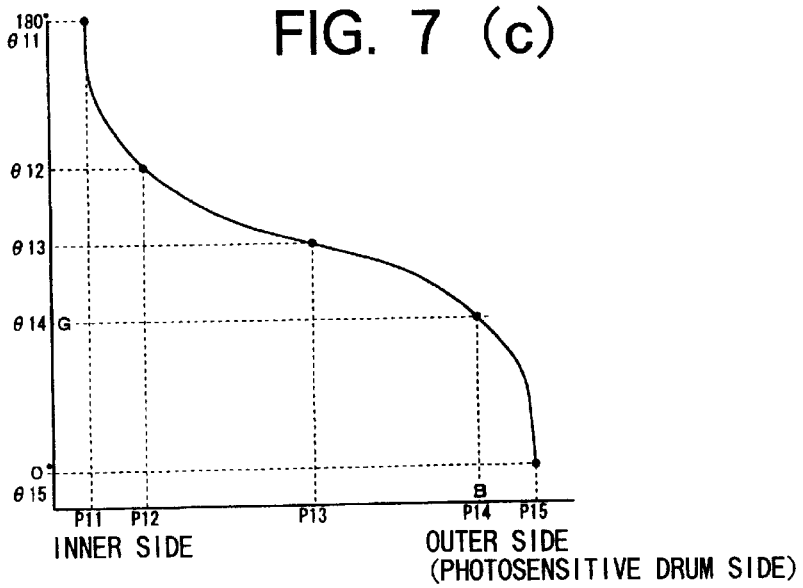

As described already, the inner liquid surface 32 serves as a free surface with respect to pressure applied thereto. The outer liquid surface 31 also serves as a free surface with respect to pressure applied thereto, and therefore becomes a planar shape. The level of the outer liquid surface 31 is determined dependently on: the surface configuration of the metal wall 12; and the contact angle G (Gk) defined for the metal wall 12 with respect to the liquid developer 30. More specifically, as shown in FIG. 7(*a*), the outer liquid surface 31 is maintained in a stable condition at a level P where an angle θ formed between the surface of the metal wall 12 and the outer liquid surface 31 is equal to the contact angle G (Gk) that is indicative of the wettability of the metal wall surface 12 with respect to the liquid developer 30. In this example, the metal wall 12 is made of nickel, and therefore the contact angle G (Gk) is about 60 degrees.

The surface configuration of the metallic wall 12 will be described below in greater detail.

FIG. 7(*b*) shows angles θ11 through θ15 defined at a plurality of positions P11–P15 on the surface of the mesh wall 12. Each angle θi (i=11, . . . or 15) is defined between the surface of the wall 12 and an imaginary plane Ii (i=11, . . . , or 15) that extends from a corresponding position Pi (i=11, . . . , or 15) normal to the through-hole extending direction E. The imaginary plane Ii is a cross-section of the through-hole 11 at a corresponding position Pi on the surface of the wall 12. As apparent from the figure, the angle θi decreases in the direction E toward the photosensitive drum 2 (upward direction in the drawing). That is, as shown in FIG. 7(*c*), the angle θi decreases as the position P becomes close to the photosensitive drum 2. Over the entire wall surface 12 from the position P11 via a position P14 to the position P15, the angle θ1 decreases from the value θ11 of 180 degrees that is greater than the contact angle G (Gk), through the value θ14 of about 60 degrees that is almost equal to the contact angle G (Gk), toward the value θ15 of zero (0) degrees that is smaller than the contact angle G (Gk).

When the liquid developer 30 is supplied from the developer supply porous member 4, the liquid developer 30 enters the through-hole 11 with its outer liquid surface 31 advancing in the through-hole 11 along the surface of the metal wall 12. When the outer liquid surface 31 reaches the position P14 whose angle θ14 almost equal to the contact angle G, the liquid surface 31 will become flat or planar and will be brought into the most stable condition in energy. Accordingly, the liquid developer 30 stops moving, and the outer liquid surface 31 will be located stably at the position P14 as shown in FIG. 7(*a*). A gap 5 is therefore created between the outer liquid level 31 and the outer surface 14 of the developer retainer 3 as shown in FIG. 7(*a*). Hereinafter, the point P where the liquid level 31 is thus maintained most stably will be referred to as "stable point B". In this case, the point P14 becomes the stable point B where the liquid surface 31 will be maintained.

Thus, according to the present embodiment, the surface configuration of the metal wall 12 is designed to adjust the angle θ1 at each position Pi so that the angle θ1 becomes equal to the contact angle G at a position Pi where the outer liquid surface 31 is desired to be maintained. More specifically, the surface configuration of the metal wall 12 is designed to allow the angle θ to decrease in a direction from the inner surface 13 to the outer surface 14. The angle θ decreases from a value greater than the current angle G to another value smaller than the contact angle G. The angle θ matches the contact angle G at the desired position P. The thus designed surface configuration of the metal wall 12 allows the hole diameter (cross-sectional area) of the through-hole 11 to change along the through-hole extending direction E.

By thus designing the surface configuration of the metal wall 12 relative to the amount of the contact angle G, it is possible to control the outer liquid level 31 to a proper position. It is possible to create the gap S of the proper amount between the outer liquid level 31 and the outer surface 14 of the developer retainer 3. Because the developer retainer 3 is positioned with its outer surface 14 being in contact with the surface 21 of the photosensitive drum 2, the gap S of the proper amount is created between the outer liquid level 31 and the latent image 20 which is formed on the photosensitive drum surface 21. It is therefore possible to properly maintain the amount of the electric field to be effected onto the outer liquid surface 31 from the photosensitive drum surface 21.

In the state described above, the liquid developer 30 is retained in the developer retainer 3. The liquid developer 30 is then selectively supplied to the photosensitive drum 2 in a manner described below.

Figure 11:
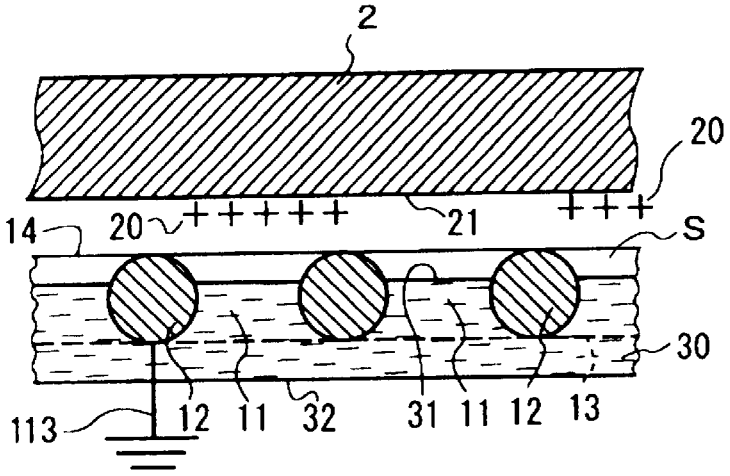
FIGS. 11(*a*) to 11(*c*) are explanatory sequential views showing the principle how liquid developer selectively adheres to a photosensitive drum.
Figure 11:
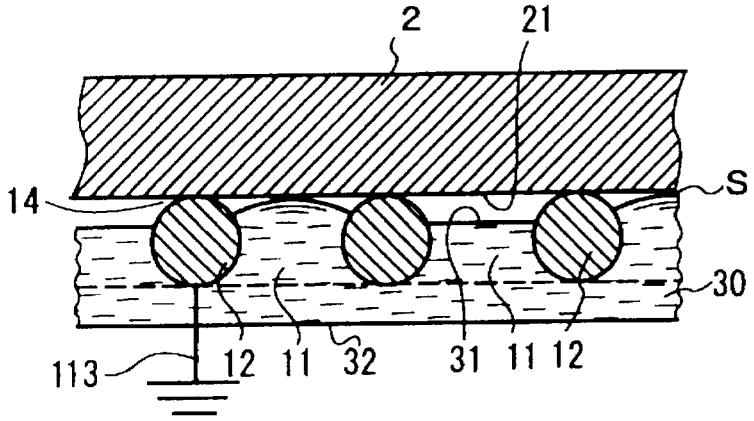
Figure 11:
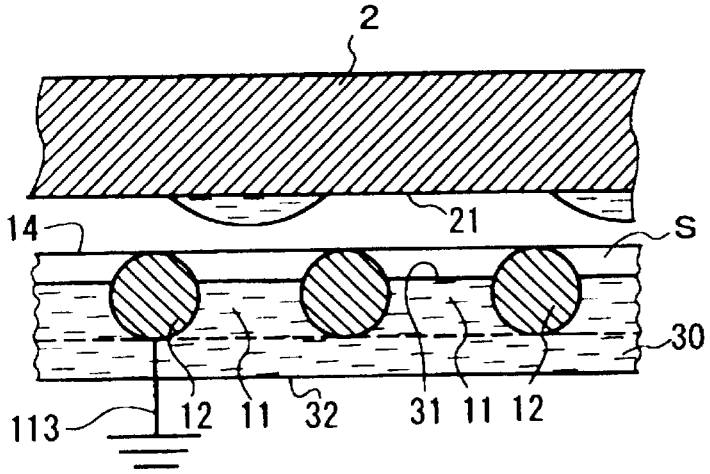

As shown in FIG. 11(*a*), the metallic walls 12 of the developer retainer 3 are electrically grounded by a ground portion 113. The liquid developer 30 is retained in developer retainer 3 so that its outer liquid level 31 be located inside from the outer surface 14 of the developer retainer 3. That is, the gap S is created between the outer liquid surface 31 and the developer retainer outer surface 14. As described already, the amount of the gap S is determined dependently on the surface configuration of the metal wall 12 and the value of the contact angle G of the metal wall 12. Accordingly, the distance S will vary little in time. The gap S is formed uniformly over the entire area of the developer retainer 3. The amount of the gap S is about a few micrometers, in this example.

When the photosensitive drum 2 and the developer retainer 3 are rotated in opposite directions as indicated by arrows in FIG. 1, the liquid developer 30 held in the developer retainer 3 gradually approaches the latent image 20 on the photosensitive drum 2. In other words, the distance between the outer liquid surface 31 of the liquid developer 30 and the electrostatic latent image 20 formed on the photosensitive drum 2 gradually decreases. Then, as shown in FIG. 11(*b*), the outer surface 14 of the developer retainer 3 is finally brought into contact with the surface 21 of the photosensitive drum 2. In this condition, the outer liquid surface 31 becomes closest to the electrostatic latent image 20. The outer liquid surface 31 becomes positioned stably with the gap S being formed between the outer liquid surface 31 and the photosensitive drum surface 21.

A part of the liquid developer 30 that is located in those through-holes 11 that confront the area of the photosensitive drum surface 21 having the charge of the electrostatic latent image 20 is electrostatically attracted toward the photosensitive drum surface 21. Thus, the liquid developer 30 comes into contact with the surface 21 of the photosensitive drum 2, and adheres to the surface 21. The surface 21 of the photosensitive drum 2 is made of the material having greater wettability with respect to the liquid developer 30 than the material of the metal wall 12. Accordingly, when the outer surface 14 of the developer retainer 3 is separated from the photosensitive drum surface 21 according to a further rotation of the developer retainer 3 and of the photosensitive drum 2, the liquid developer 30 remains adhering to the photosensitive drum 2 as shown in FIG. 11(*c*).

On the other hand, a remaining part of the liquid developer 30 that is located in other through-holes 11 that confront the photosensitive drum area having no charge is influences by no electrostatic forces. The liquid developer 30 is not attracted to the photosensitive drum surface 21, and therefore does not come into contact with the photosensitive drum surface 21. Thus, the liquid developer 30 remains as being retained in the fine through-holes 11. Because the liquid developer 30 does not come into contact with the area where the latent image 20 is not formed, any contamination or fog doe not easily occur. Thus, the liquid developer 30 retained in the fine through-holes 11 selectively adheres to the photosensitive drum surface 21 and develops the electrostatic latent image 20 into a visible image.

In the above-described example, the metal wall 12 has a circular cross-section. However, the metal wall 12 may have other various shapes whose surface configuration can allow the hole diameter (cross-sectional area) of the through-hole 11 to change along the through-hole extending direction E and whose surface configuration presents the angle θ of the wall surface 12 to decrease from a value greater than the contact angle G toward another value smaller than the contact angle G in the direction E toward the photosensitive drum 2.

Figure 8:
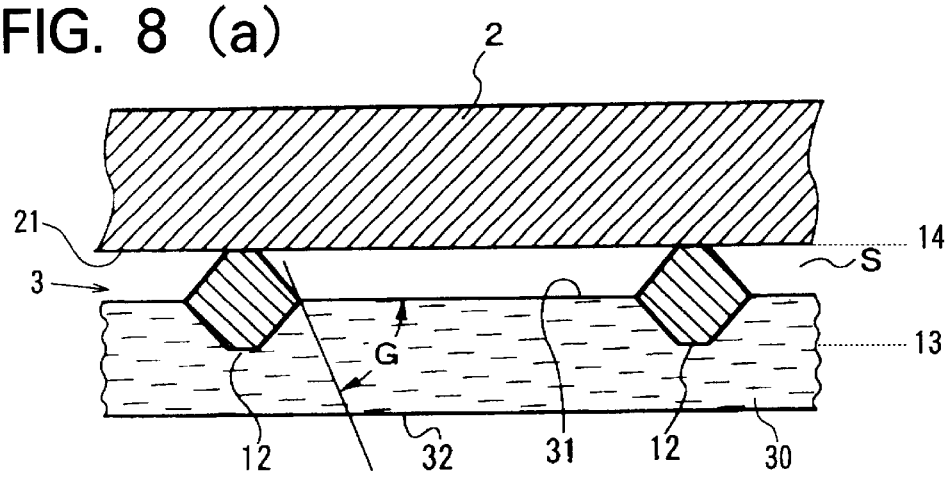
FIG. 8(*a*) schematically shows the state how liquid developer is retained in the developer retainer whose constituent wall has a hexagonal cross-section.
Figure 8:
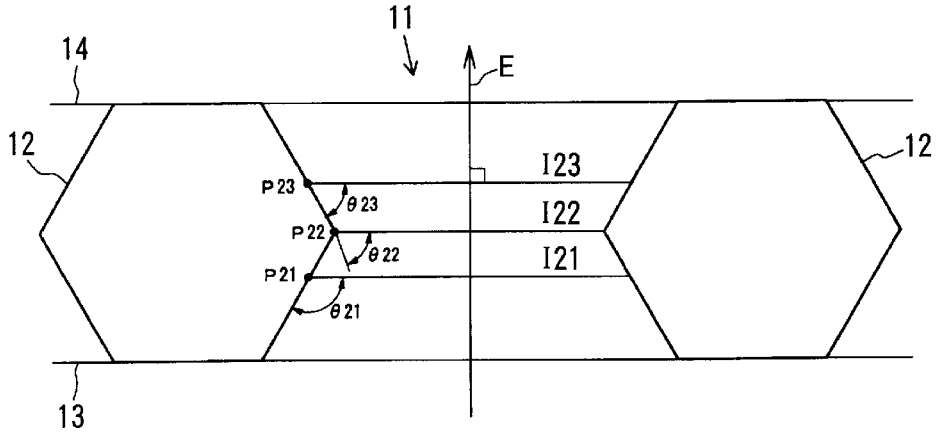
Figure 8:
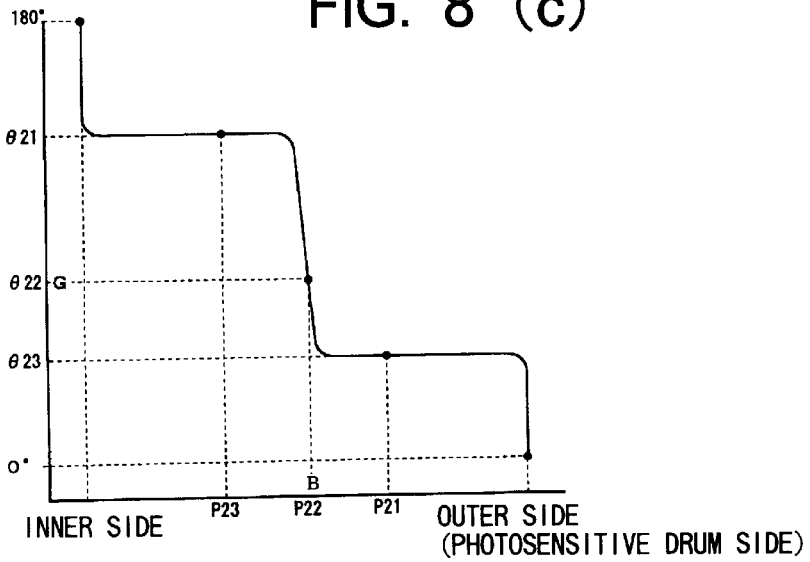

For example, the metal wall 12 may have a hexagonal cross-section as shown in FIG. 8(*a*). In this case, the hole diameter (cross-sectional area) of the through-hole 11 becomes the smallest at its middle portion along the through-hole extending direction E. The hole diameter (cross-sectional area) gradually increases from the middle portion in directions toward both of the inner and outer surfaces 13 and 14.

FIG. 8(*b*) shows angles θ21 through θ23 defined at a plurality of positions P21–P23 on the surface of the wall 12. Each angle θi (i=21, 22, or 23) is formed between the surface of the wall 12 and an imaginary cross-sectional plane Ii (i=21, 22, or 23) that extends from a corresponding position Pi (i=21, 22 or 23) normal to the through-hole extending direction E. As apparent from the figure, the metal wall 12 has an edge portion on its middle portion along the through-hole extending direction E. At the edge portion, the hold diameter (cross-sectional area) of the through-hole 11 becomes the smallest along the through-hole extending direction E.

As shown in FIG. 8(*c*), the angle θi decreases from the angle θ21 that is greater than the contact angle G (60 degrees) toward the angle θ23 that is smaller than the contact angle G along the through-hole extending direction E toward the photosensitive drum 2. At the edge portion, the angle θ greatly changes from the value θ21 to the value θ23. The angle θ thus greatly changes through the contact angle G (60 degrees) in such a small area at that edge portion. It is therefore known that a position P22 whose angle θ22 is equal to the contact angle G exists within the small area on the edge portion.

When the liquid developer 30 is supplied from the developer supply porous member 4, the liquid developer 30 enters the through-hole 11 to advance along the surface of the metal wall 12. The liquid developer 30 will, however, stop moving when its outer liquid surface 31 reaches the position P22 whose angle θ22 is equal to the contact angle G. The liquid developer 30 will not advance further in the through-hole 11 toward the photosensitive drum 2. The outer liquid surface 31 is maintained stably as being fixed at the position P22. Thus, the point P22 becomes the stable point B. A gap S is therefore created between the outer liquid level 31 and the outer surface 14 of the developer retainer 3 as shown in FIG. 8(*a*). Because the point P22 exists somewhere in the small region on the edge portion, the outer liquid level 31 can be properly positioned within the small region in the edge portion that is distant from the outer surface 14 by the proper amount of gap S. Because the developer retainer 3 is positioned with its outer surface 14 being in contact with the surface 21 of the photosensitive drum 2, the gap S of the proper amount is created between the outer liquid surface 31 and the latent image 20 which is formed on the photosensitive drum surface 21. Accordingly, liquid developer 30 can be properly attracted electrostatically to the photosensitive drum surface 21 in the same manner as described with reference to FIGS. 11(*a*)–11(*c*).

Figure 9:
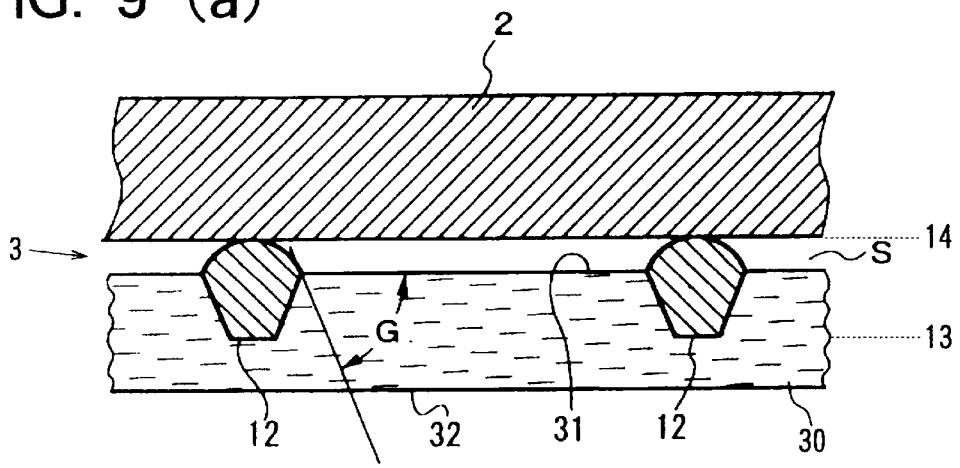
FIG. 9(*a*) schematically shows the state how liquid developer is retained in the developer retainer whose constituent wall has a curved surface and slanted surfaces.
Figure 9:
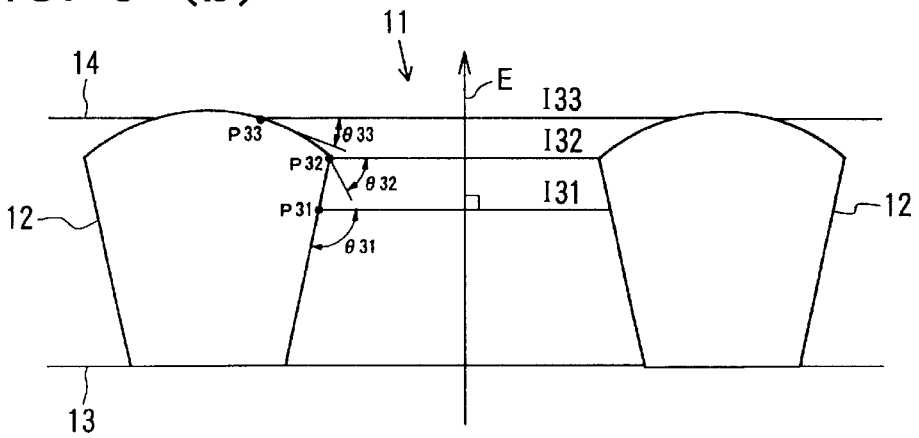
Figure 9:
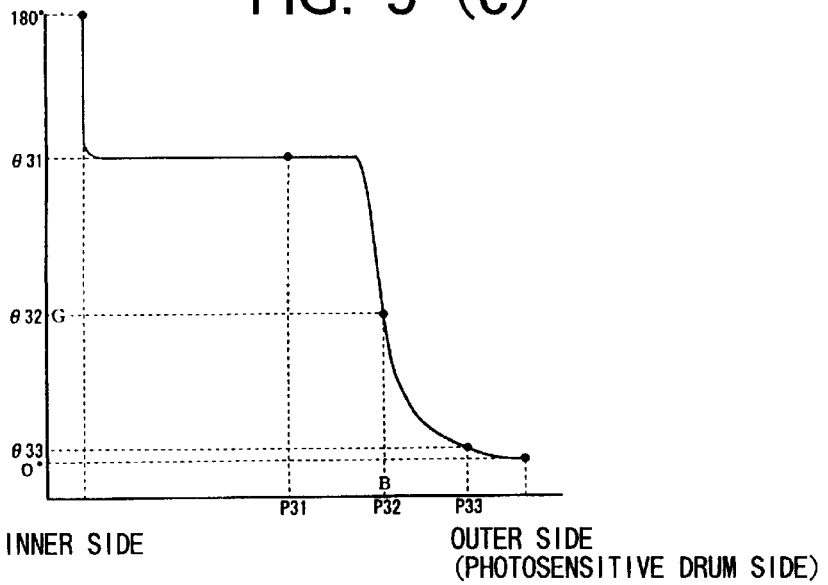

According to another example, as shown in FIG. 9(*a*), the metal wall 12 has a cross-section in a combined shape of the circular cross-section and the hexagonal cross-sections. That is, the metal wall 12 has a surface configuration in which a curved surface portion is connected, at a middle edge portion, to a slanted surface portion. In this case, the hole diameter (cross-sectional area) of the through-hole 11 becomes the smallest at its portion corresponding to the middle edge portion of the metal wall 12. The hole diameter (cross-sectional area) then increases in directions toward both of the inner and outer surfaces 13 and 14.

FIG. 9(*b*) shows angles θ31 through θ33 defined at a plurality of positions P31–P33 on the surface of the metal wall 12. Each angle θi (i=31, 32, or 33) is formed between the surface of the metal wall 12 and an imaginary cross-sectional plane Ii (i=31, 32, or 33) that extends from a corresponding position Pi (i=31, 32, or 33) normal to the through-hole extending direction E. As apparent from the figure, the metal wall 12 has the middle edge portion on its middle portion along the through-hole extending direction E. At the middle edge, the hole diameter (cross-sectional area) of the through-hole 11 becomes the smallest along the through-hole extending direction E.

As shown in FIG. 9(*c*), the angle θ decreases from the angle θ31 that is greater than the contact angle G (60 degrees) toward the angle θ33 that is smaller than the contact angle G along the through-hole extending direction E toward the photosensitive drum 2. At the middle edge portion, the angle θ greatly changes from the value θ31 to the value θ33. The angle θ thus greatly changes through the contact angle G in such a small area on the middle edge portion. It is therefore known that a position P32 whose angle θ32 is equal to the contact angle G exists within the small area on the edge portion.

When the liquid developer 30 enters the through-hole 11 to advance along the surface of the metal wall 12, the liquid developer 30 will stop moving when the outer liquid level 31 reaches the position P32 whose angle θ32 is equal to the contact angle G. The liquid developer 30 will not advance further in the through-hole 11 toward the photosensitive drum 2. The outer liquid surface 31 is maintained stably as being fixed at the position P32. Thus, the point P32 becomes the stable point B. A gap S is therefore created between the outer liquid level 31 and the outer surface 14 of the developer retainer 3 as shown in FIG. 9(*a*). Because the point P32 exists somewhere in the small region on the middle edge portion, the outer liquid level 31 can be properly positioned within the small region in the middle edge that is properly distant from the developer retainer outer surface 14 by the gap S as shown in FIG. 9(*a*). Because the developer retainer 3 is positioned with its outer surface 14 being in contact with the surface 21 of the photosensitive drum 2, the gap S of the proper amount is created between the outer liquid surface 31 and the latent image 20 which is formed on the photosensitive drum surface 21. Accordingly, the liquid developer 30 can be properly attracted electrostatically to the photosensitive drum surface 21 in the same manner as described with reference to FIGS. 11(*a*)–11(*c*).

Figure 10:
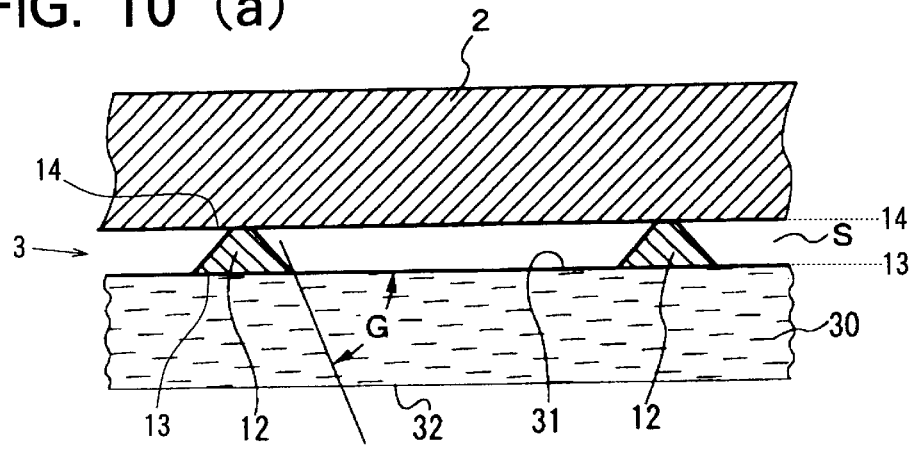
FIG. 10(*a*) schematically shows the state how liquid developer is retained in the developer retainer whose constituent wall has a trapezoidal cross-section.
Figure 10:
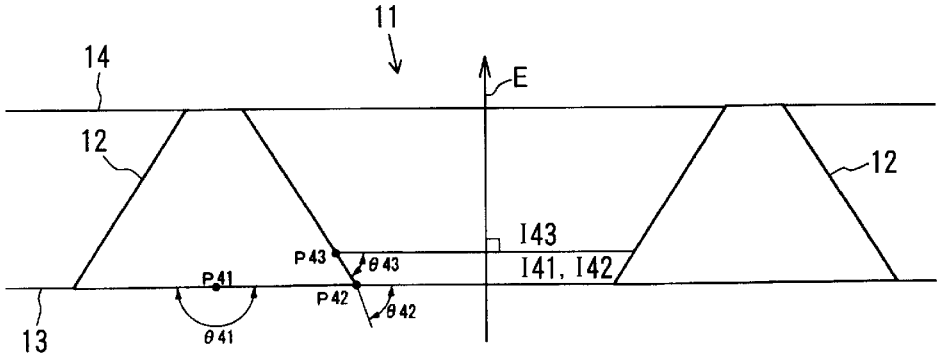
Figure 10:
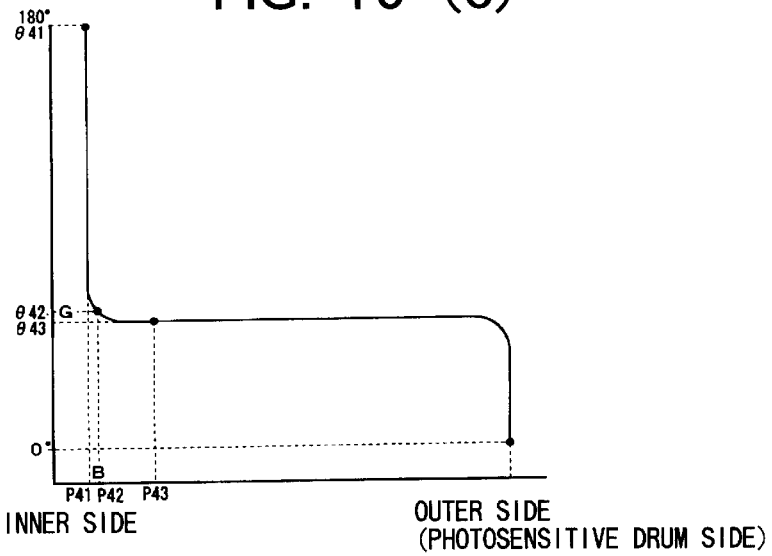

According to still another example, the metal wall 12 has a trapezoidal cross-section as shown in FIG. 10(*a*). That is, the metal wall 12 has a surface configuration in which a single slanted surface is connected, at its inner side edge, to the inner surface 13. In this case, the hole diameter (cross-sectional area) of the through-hole 11 gradually increases along the through-hole extending direction E from the inner surface 13 to the outer surface 14.

FIG. 10(*b*) shows angles θ41 through θ43 defined at a plurality of position P41–P43 on the surface of the metal wall 12. Each angle θ1 (i=41, 42, or 43) is formed between the surface of the metal wall 12 and an imaginary cross-sectional plane Ii (i=41, 42, or 43) that extends from a corresponding position Pi (i=41, 42, or 43) normal to the through-hole extending direction E. As apparent from the figure, the metal wall 12 has an inner side edge on the inner surface 13.

As shown in FIG. 10(*c*), the angle θ decreases from the angle θ41 that is greater than the contact angle G (60 degrees) toward the angle θ43 that is smaller than the contact angle G along the through-hole extending direction E toward the photosensitive drum 2. For example, the angle θ 43 is about 50 degrees that is smaller than the contact angle G of 60 degrees. At the inner edge, the angle θ greatly changes from the amount θ41 to the amount θ43. The angle θ thus greatly changes through the contact angle G in such a small area on the inner edge. It is therefore known that a position P42 whose angle θ42 is equal to the contact angle G exists within the small area on the inner edge.

When the liquid developer 30 is supplied from the developer supply porous member 4 to advance toward the developer retainer 3, the liquid developer 30 will stop moving when the outer liquid level 31 reaches the position P42 whose angle θ42 is equal to the contact angle G, and will be maintained stably at that position P42. The liquid developer 30 will not enter the through-hole 11. Accordingly, the outer liquid surface 31 is maintained as being fixed at the position 42. Thus, the point P42 becomes the stable point B. A gap S is therefore created between the outer liquid level 31 and the outer surface 14 of the developer retainer 3 as shown in FIG. 10(*a*). Because of the point P42 exists somewhere in the small region on the inner side edge of the metal wall 12, the outer liquid level 31 can be properly positioned within the small region in the inner side edge that is distant from the developer retainer outer surface 14 by the proper amount of gap S as shown in FIG. 10(*a*). Because the developer retainer 3 is positioned with its outer surface 14 being in contact with the surface 21 of the photosensitive drum 2, the gap S of the proper amount is created between the outer liquid surface 31 and the latent image 20 which is formed on the photosensitive drum surface 21. Accordingly, the liquid developer 30 can be properly attracted electrostatically to the photosensitive drum surface 21 in the same manner as described with reference to FIGS. 11(*a*)–11(*c*).

Thus, according to this example, the outer liquid surface 31 is maintained in the vicinity of the open ends of the through-holes 11 on the inner side surface 13 as shown in FIG. 10(*a*). Accordingly, the outer liquid level 31 is not made too close to the latent image 20 on the photosensitive drum 2, but is separated from the latent image 20 with the proper distance S.

It is noted that according to the example of FIGS. 10(*a*)–10(*c*), the liquid 30 cannot enter the through-hole 11 beyond the stable point P42, but is maintained in the vicinity of the inner side surface 13 of the developer retainer 3. Contrarily, according to the examples of FIGS. 7(*a*)–9(*c*), the liquid 30 enters the through-holes 11 beyond their inner side edges. It is noted, however, that in all of the examples of FIGS. 7(*a*)–10(*c*), the liquid developer 30 is properly retained in the developer retainer 3 with its outer liquid level 31 being located inside from the outer surface 14 of the developer retainer 3. That is, in the examples of FIGS. 7(*a*)–9(*c*), the liquid developer 30 is retained in the developer retainer 3 with its outer liquid level 31 being located between the outer surface 14 and the inner surface 13. A part of the liquid developer 30 exists in the through-holes 11. In the example of FIGS. 10(*a*)–10(*c*), the liquid developer 30 is retained in the developer retainer 3 with its outer liquid level 31 being located in the vicinity of the inner surface 13. Almost no part of the liquid developer 30 exists in the through-holes 11. Because the outer liquid level 31 is thus properly located inside from the outer surface 14 of the developer retainer 3 in all of the examples, the proper amount of gap S can be created between the outer liquid level 31 and the outer surface 14 of the developer retainer 3. Because the developer retainer 3 is positioned with its outer surface 14 being in contact with the surface 21 of the photosensitive drum 2, the gap S of the same proper amount is created between the outer liquid surface 31 and the photosensitive drum surface 21 as shown in FIG. 7(*a*), 8(*a*), 9(*a*), and 10(*a*). A proper amount of electric field can be affected from the photosensitive drum surface 21 onto the liquid developer 30.

Next, details of other elements in the image forming apparatus 1 will be described below.

The transfer roller 9 is comprised from, for example, a rubber roller that is made of a silicon rubber, an urethane rubber, or the like. Alternatively, the transfer roller 9 may be made of one of those rubbers that additionally includes carbon to increase its electrical conductivity so that application of a bias voltage to the roller 9 will promote the transfer of the developed image from the photosensitive drum 2 to the recording paper 8.

The cleaning roller 10 is comprised from a sponge roller which has a good absorption characteristic of the liquid developer 30.

With the above-described structure, the image forming apparatus 1 of the present embodiment operates in a manner described below.

In the developer supply drum 100, the developer storage porous member 48 is constantly saturated with liquid developer 30. The developer storage porous member 48 is in contact with the developer supply porous member 4 via the contact portions 47. Thus, the developer storage porous member 48 properly supplies the liquid developer 30 to the developer supply porous member 4. The amount by which the developer storage porous member 48 supplies the liquid developer 30 to the developer supply porous member 4 can be adjusted by setting a proper balance between the porous rate (foam rate) of the developer storage porous member 48 and the porous rate (foam rate) of the developer supply porous member 4.

When the developer supply drum 100 rotates, the developer supply porous member 4 and the developer retainer 3 rotate together in close relationship with each other. As a result, the developer supply porous member 4 supplies the liquid developer 30 to the developer retainer 3. The liquid developer 30 is retained in the developer retainer 3 with its outer liquid surface 31 being maintained at the proper position according to the already-described principle.

The surface 21 of the photosensitive drum 2 is uniformly electrically charged by the charging device 6. The photosensitive drum 2 is then selectively exposed to light by the selective exposure device 7 to form an electrostatic latent image 20 on the surface 21. The electrostatic latent image 20 is a positively-charged image.

The photosensitive drum 2 and the developer retainer 3 are rotated while contacting each other. The liquid developer 30 selectively adheres to the electrostatic latent image 20 in the manner described already. Thus, the latent image 20 is developed into a visible image by the liquid developer 30. More specifically, when the liquid developer 30 retained in the developer retainer 3 approaches the latent image 20, the liquid surface of the liquid developer 30 is attracted toward the photosensitive drum surface 21, by the electric field, at regions where the positively-charged latent image 20 exists. As a result, the liquid developer 30 adheres to the latent image 20. At regions where no latent image 20 is formed, due to the wettability of the mesh wall 12 with respect to the liquid developer 30, the liquid level 31 is maintained as being fixed. Accordingly, the liquid developer 30 does not adhere to the portion where no latent image 20 is formed. The selective adhesion of the liquid developer 30 only onto the portion where the latent image 20 is formed develops the latent image 20 into a visible image.

The recording paper 8 is fed by a feeding device (not shown) to a nip zone between the photosensitive drum 2 and the transfer roller 9. At this nip zone, the developer image on the photosensitive drum 2 is transferred to the recording paper 8 to form a final image thereon. The liquid removed by the cleaning roller 10 to return the photosensitive drum surface 21 to its initial state. Repeating the sequence of operations described above, the image forming apparatus 1 forms desired images on the recording paper 8. The paper 8 is then discharged out of the apparatus 1.

As described above, the developer retainer 3 can retain the liquid developer 30 stably while maintaining its outer liquid surface 31 to be distant from the latent image 20 with the accurately-controlled small gap S being formed therebetween. Development of the latent image can therefore be attained with a small energy. It is possible to form high-quality images with full gradation within a short period of time.

Because the developer supply porous member 4 is located in confrontation with the inner side surface 13 of the developer retainer 3 with a gap being formed therebetween, the liquid developer 30 retained in the developer retainer 3 can be applied with no undesirable pressure. Accordingly, the liquid developer 30 is retained substantially freely in pressure. The outer liquid surface level 31 of the liquid developer 30 can be maintained as being fixed.

Because the developer supply porous member 4 is of a cylindrical shape and is located inside of and concentrically with the roll-shaped developer retainer 3, liquid developer 30 can be smoothly supplied from the porous member 4 to the developer retainer 3 at a developing portion where the developer retainer 3 is contacted with the photosensitive drum 2.

The developer tank 5 is located inside the roll-shaped developer supply porous member 4, and supplies liquid developer 30 to the porous member 4. The entire structure of the developer supply device 100 is therefore made compact. Because the developer supply porous member 4 is supplied with liquid developer 30 from the tank 5, the porous member 4 can continuously supply liquid developer 30 to the developer retainer 3. It is possible to form images stably for a long period of time.

The developer retainer 3 having the metallic walls 12 with the above-described various cross-sectional shapes is produced in an electroforming process in a manner described below.

Figure 12:
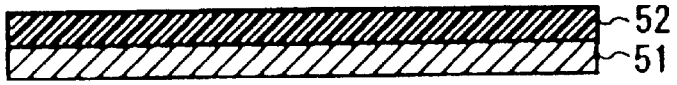
FIGS. 12(*a*)–12(*e*) are process diagrams showing the processes for producing, through an electroforming process, the developer retainer whose wall has the circular cross-section of FIGS. 7(*a*)–7(*c*)
Figure 12:
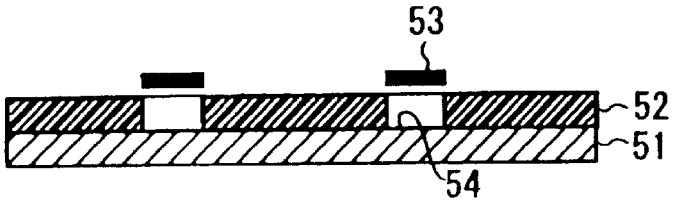
Figure 12:
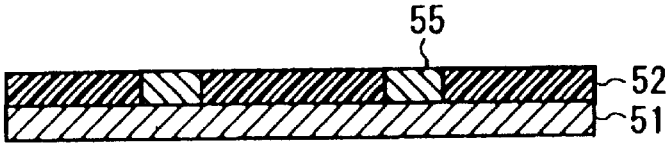
Figure 12:
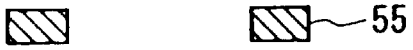
Figure 12:
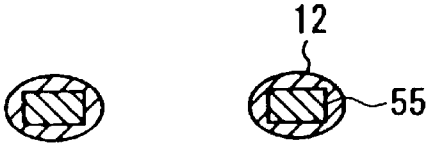

FIG. 12(*a*)–12(*e*) show a process of producing the developer retainer 3 that is comprised from the metal walls 12 having the circular cross-section of FIG. 7(*a*).

First, as shown in FIG. 12(*a*), a base metal 51 made of stainless steel, for example, is prepared. Then, photoresist 52 which is of a photo-setting negative type and which is in a liquid or sheet condition is provided over the base metal 51. The resist layer 52 is provided over the base metal 51 by coating resist on the base metal 51. Or, the resist layer 52 may be provided over the base metal 51 by attaching a resist onto the base metal 51 while thermally pressing it against the base metal 51. Next, as shown in FIG. 12(*b*), a light-shielding mask 53 is provided over the photoresist layer 52 at positions where the metal walls 12 are desired to be formed. Then, the photoresist 52 is selectively exposed to light through the mask 53. As a result, the exposed portions of the negative type photoresist are optically set or solidified. After the exposure process, the portion of the resist 52 that is covered by the mask 53 and therefore that is not exposed to light is removed from the surface of the base metal 51. Then, metal 55 is electrodeposited onto the exposed surface of the base metal 51.

It is noted that before performing the electrodepositing process, the base metal 51 may be processed to facilitate removal of the subsequently-deposited layers 55. This process employs formation of an oxidized film, for example, on the surface of the base metal 51. After this process, the electrodeposition process is performed to deposit nickel metal 55 onto the exposed surface of the base metal 51 by immersing the entire plate into a plate bath. For example, the entire plate is immersed into a plate bath of nickel sulfamate, in which nickel sulfate or nickel sulfamate is added as an ion source. As a result, a nickel metal layer 55 is electrodeposited on the exposed surface of the base metal 51. When the nickel metal layer 55 grows to have a desired thickness as shown in FIG. 12(*c*), the entire plate is rinsed with water to remove the resist 52 from the base metal 51, and the metal layer 55 is released from the base metal 51. As shown in FIG. 12(*d*), the thus obtained metal layer 55 has a rectangular cross-section. In order to modify the cross-sectional shape of the metal layer 55 into the desired circular shape, the metal layer 55 is again immersed in the plating bath so that a metal layer will be additionally electrodeposited entirely over the metal layer 55. As a result, a mesh sheet (developer retainer) 3 comprised from the walls 12 having the circular cross-section is obtained as shown in FIG. 12(*e*).

Figure 13:
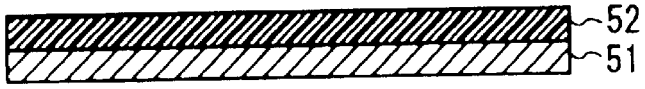
FIGS. 13(*a*)–13(*g*) are process diagrams showing the processes for producing, through an electroforming process, the developer retainer whose wall has the hexagonal cross-section of FIGS. 8(*a*)–8(*c*)
Figure 13:
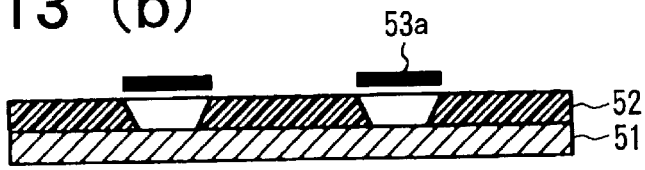
Figure 13:
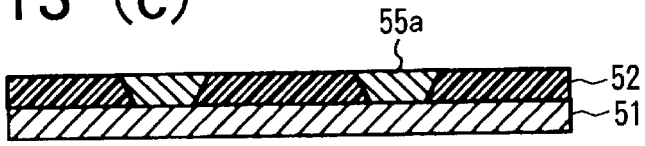
Figure 13:
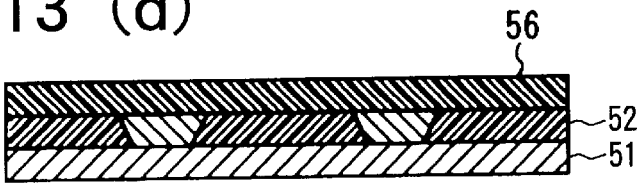
Figure 13:
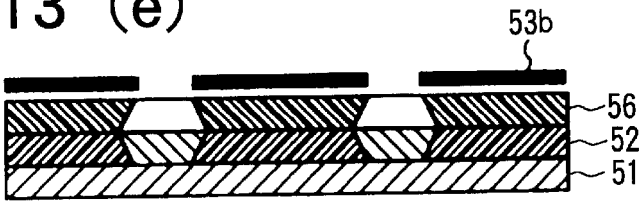
Figure 13:
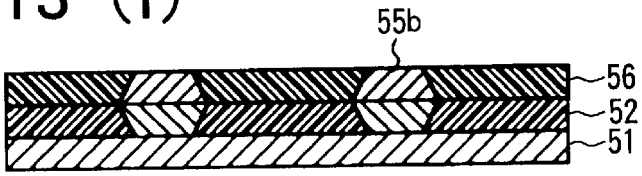
Figure 13:
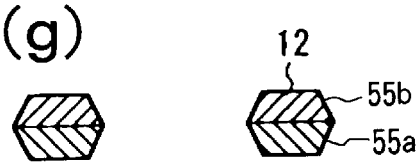

FIGS. 13(*a*)–13(*g*) show the process of forming the developer retainer 3 that is comprised from the metal walls 12 having the hexagonal cross-section of FIG. 8(*a*).

Similarly to the case of forming the metal walls 12 of the circular cross-section, a resist layer 52 of a negative type is first provided over a base metal 51 as shown in FIG. 13(*a*). The resist layer 52 is provided over the base metal 51 by coating resist onto the base metal 51. Or, the resist layer 52 may be provided over the base metal 51 by attaching a resist to the base metal 51 while pressing it against the base metal 51. Then, a mask 53*a* is provided over the photoresist 52 at positions where the metal walls 12 are desired to be formed. The photoresist 52 is then exposed to light through the mask 53*a*. During the exposure process, due to diffraction action of light, the photoresist 52 is selectively exposed to light into a shape whose area gradually increases in a direction the light travels as shown in FIG. 13(*b*). Accordingly, the remaining non-light-exposed portion of the resist 52 has its area gradually decreasing in a direction toward the metal base 51. Then, the non-light-exposed photoresist portion 52 is removed from the surface of the base metal 51, and a metal layer 55*a* is electrodeposited on the exposed surface of the base metal 51 as shown in FIG. 13(*c*). As a result, the metal layer 55*a* is formed in a shape whose area gradually increases away from the base metal 51.

Then, as shown in FIG. 13(*d*), another resist layer 56 is provided over the photoresist layer 52 and the metal layer 55*a*. The resist layer 56 is of a positive type. Then, as shown in FIG. 13(*e*), another mask 53*b* is provided over the photoresist 56 at positions where through-holes 11 are desired to be formed. Then, the photoresist 56 is exposed to light through the mask 53*b*. Due to the diffraction action of the light, the photoresist 56 is selectively exposed to light in the shape whose area gradually increases in the light travelling direction. Then, the light-exposed portion of the photoresist 56 is removed from the surface of the metal layer 55*a*, and an additional metal layer 55*b* is electrodeposited over the exposed surface of the metal layer 55*a* as shown in FIG. 13(*f*). As a result, the additional metal layer 55*b* is formed to have its area gradually decreasing away from the metal layer 55*a*. Thus, two metal layers 55*a* and 55*b* are formed in combination. The two metal layers 55*a* and 55*b* have surfaces slanted in opposite directions. Then, the resist layers 52 and 56 are removed, and the combined metal layers 55*a* and 55*b* are released from the base metal 51. As a result, a mesh sheet (developer retainer) 3 comprised from the walls 12 having the hexagonal cross-section is obtained as shown in FIG. 13(*g*).

Figure 14:
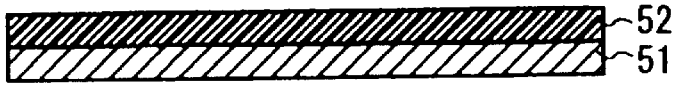
FIGS. 14(*a*)–14(*e*) are process diagrams showing the processes for producing, through an electroforming process, the developer retainer whose wall has both the curved and slanted surfaces of FIGS. 9(*a*)–9(*c*)
Figure 14:
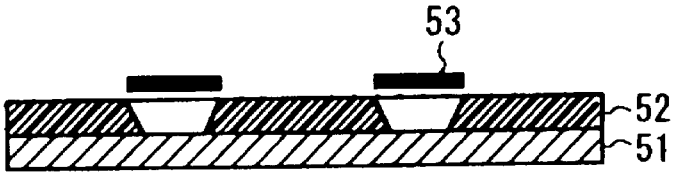
Figure 14:
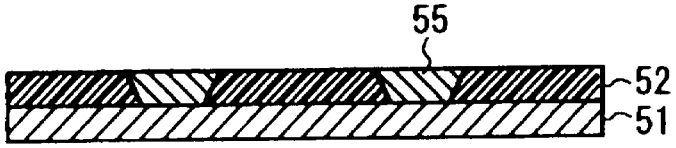
Figure 14:
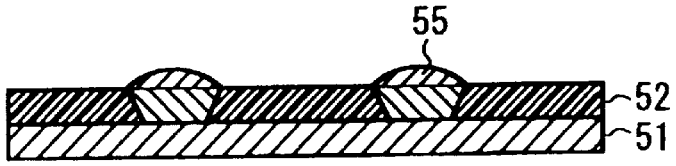
Figure 14:
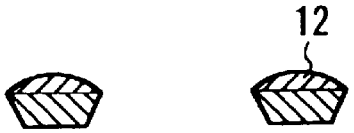

FIGS. 14(*a*)–14(*e*) show the process of producing the developer retainer 3 comprised from the metal walls 12 that have both the curved and slanted surfaces as shown in FIG. 9(*a*).

First, a negative type resist layer 52 is provided over a base metal 51 as shown in FIG. 14(*a*). The resist layer 52 is exposed to light through a mask 53 as shown in FIG. 14(*b*). The resist 52 is selectively exposed to light in a shape whose area gradually increases in a direction the light travels. Then, the non-light-exposed portion of the photoresist 52 is removed from the surface of the base metal 51. A metal layer 55 is then electrodeposited on the exposed surface of the base metal 51 as shown in FIG. 14(*c*). The metal layer 55 therefore grows in a shape whose area gradually increases in a direction away from the base metal 51. Even after the metal layer 55 grows to the thickness equal to that of the resist layer 52, the electrodeposition process is continued. As a result, the metal 55 further grows into a convex-shape as shown in FIG. 14(*d*). Then, the photoresist 52 is removed from the base metal 51, and the metal layer 55 is released from the base metal 51. As a result, a mesh sheet (developer retainer) 3 comprised from the walls 12 having both the curved and slanted surfaces is obtained as shown in FIG. 14(*e*).

Figure 15:
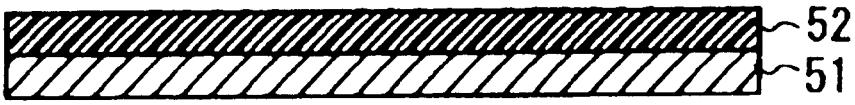
FIGS. 15(*a*)–15(*d*) are process diagrams showing the processes for producing, through an electroforming process, the developer retainer whose wall has the slanted surfaces of FIGS. 10(*a*)–10(*c*)
Figure 15:
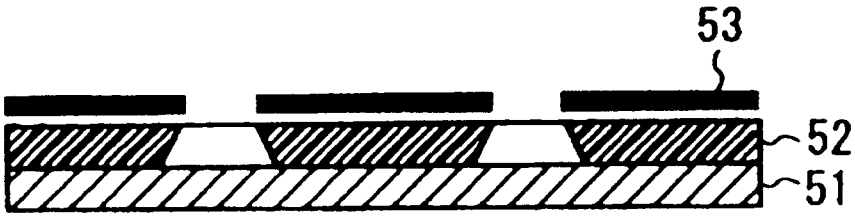
Figure 15:
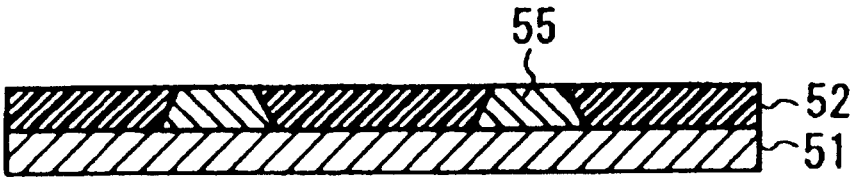
Figure 15:
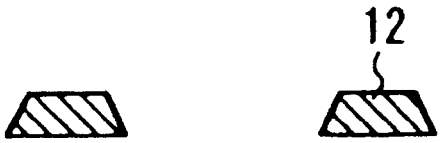

FIGS. 15(*a*)–15(*d*) show the process of producing the developer retainer 3 comprised from the metal walls 12 having the trapezoidal cross-section of FIG. 10(*a*).

A resist layer 52 of a positive type photoresist is first provided over a base metal 51 as shown in FIG. 15(*a*). The resist is then exposed to light through a mask 53 into a shape whose area gradually increases in a direction the light travels as shown in FIG. 15(*b*). After the light-exposed portion of the resist 52 is removed from the surface of the base metal 51, a metal layer 55 is electrodeposited onto the exposed surface of the base metal 51 as shown in FIG. 15(*c*). The metal layer 55 has therefore a shape whose area gradually decreases in a direction away from the base metal 51. Then, the resist 52 is removed, and the base metal 51 is released from the metal layer 55. As a result, a mesh sheet (developer retainer) 3 comprised from the walls 12 having the trapezoidal cross-section is obtained as shown in FIG. 15(*d*).

Through the above-described electroforming methods, it is possible to produce, with high precision and at a low cost, the developer retainer 3 formed with the number of highly-fine through-holes 11. The thus produced developer retainer 3 can attain high quality image formation.

Figure 16:
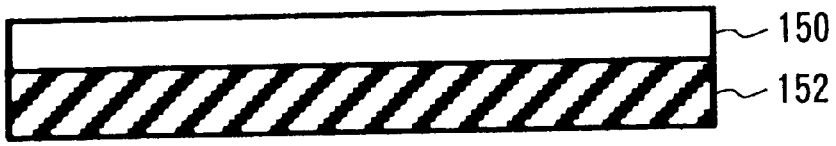
FIGS. 16(*a*)–16(*d*) are process diagrams showing the processes for producing, through an etching process, the developer retainer whose wall has the slanted surfaces of FIGS. 10(*a*)–10(*c*)
Figure 16:
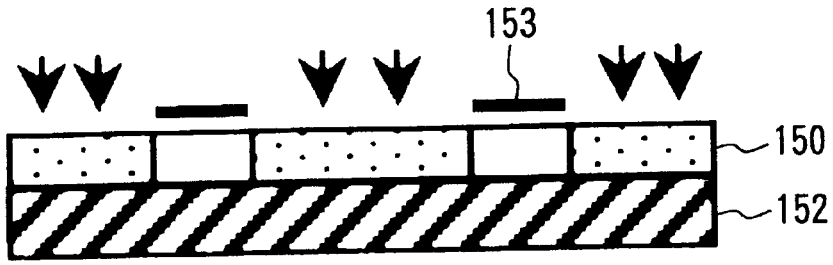
Figure 16:
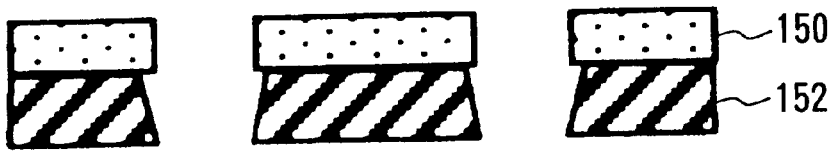
Figure 16:
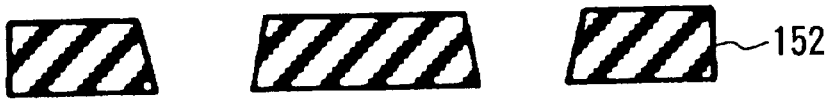

In the above description, the developer retainer 3 is produced through the electroforming process. However, the developer retainer 3 can be produced through a well-known etching process. That is, the developer retainer 3 can be produced through a process shown in FIGS. 16(*a*)–16(*d*), for example. According to this etching process, a metal plate 152, such as a copper plate or a nickel plate, is prepared. A negative type photoresist 150 is provided over the metal plate 152 as shown in FIG. 16(*a*). Then, the negative type photoresist 150 is selectively exposed to light through a mask 153 as shown in FIG. 16(*b*). Next, the metal plate 152 is etched as shown in FIG. 16(*c*). By removing the photoresist 150 from the metal plate 152, a mesh sheet (developer retainer) 3 comprised from the walls 12 of the desired shape is obtained as shown in FIG. 16(*d*). Also through the etching method, it is still possible to produce the developer retainer 3 with high precision and at a low cost.

The developer retainer 3 may be produced through other various types of photofabrication processes that perform electroforming or etching using a photoresist.

Next, various modifications of the image forming apparatus 1 will be described.

Figure 17:
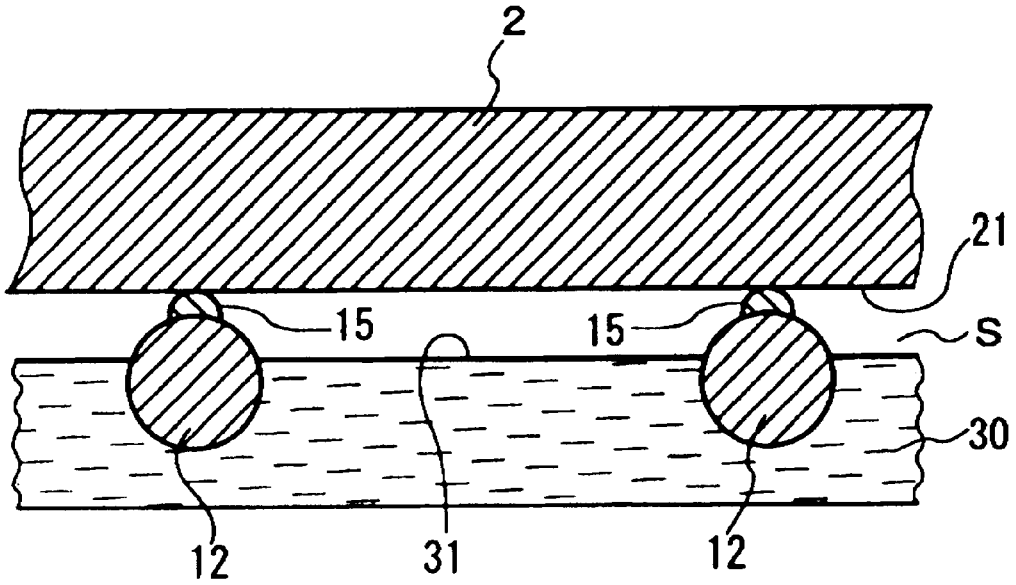
FIG. 17 is a schematical view of a part of a developer retainer according to a modification, wherein a protrusion is provided to the developer retainer.

According to a first modification, as shown in FIG. 17, a protrusion 15 is provided on the outer surface 14 of the developer retainer 3. By adjusting the height of the protrusion 15, it is possible to more precisely set, to a proper amount, the gap S between the outer liquid surface 31 and the photosensitive drum surface 21.

Figure 18:
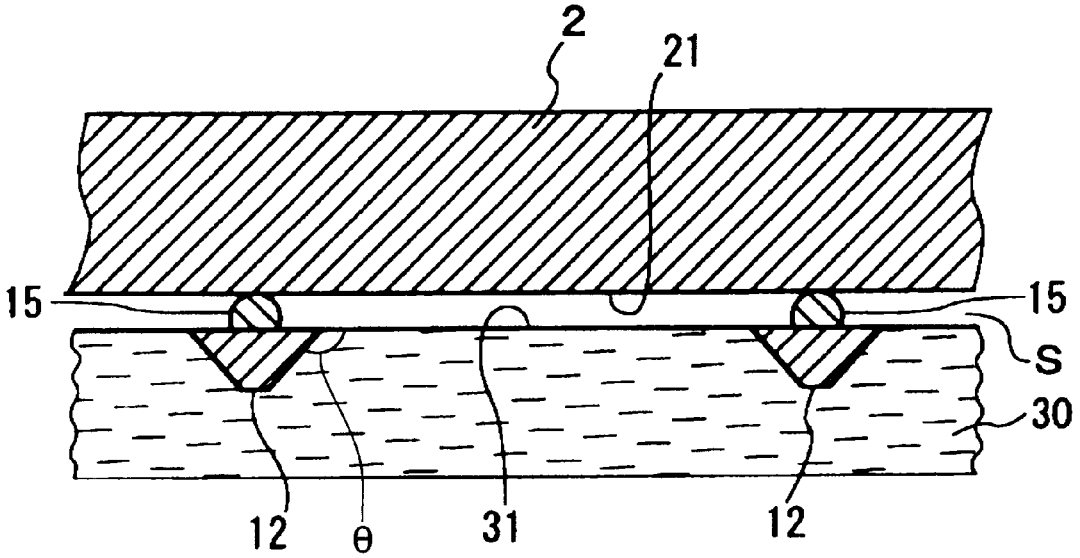
FIG. 18 is a schematical view of a part of the developer retainer in another modification.

By adjusting the height of the protrusion 15, it is possible to create the proper amount of gap S between the outer liquid surface 31 and the photosensitive drum surface 21 regardless of the cross-sectional shape of the mesh wall 12. That is, according to another modification of FIG. 18, the protrusion 15 is provided even to the metal wall 12 whose cross-sectional shape allows the outer liquid level 31 to advance to the vicinity of the outer surface 14 of the developer retainer 3. That is, for the entire surface of the metal wall 12, the angle θ defined between the metal wall surface with respect to the cross-sectional plane of the through-hole 11 is greater than the contact angle G of the metal wall 12 with respect to the liquid developer 30. In this case, the outer liquid level 31 advances to the vicinity of the outer surface 14 of the developer retainer 3. Still in this case, the protrusion 15 ensures that a gap S of a proper amount be created between the outer liquid surface 31 and the photosensitive drum surface 21.

Figure 19:
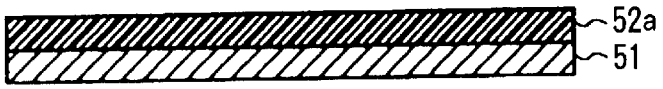
FIGS. 19(*a*)–19(*g*) are process diagrams showing the processes for producing the developer retainer formed with protrusions as shown in FIG. 18.
Figure 19:
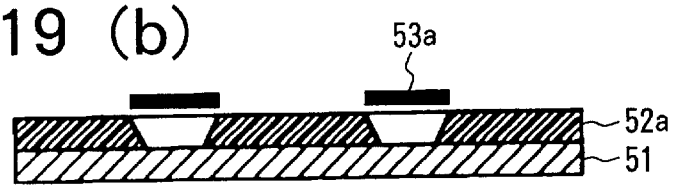
Figure 19:
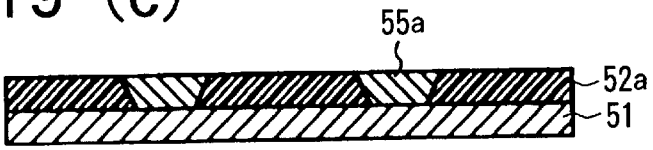
Figure 19:
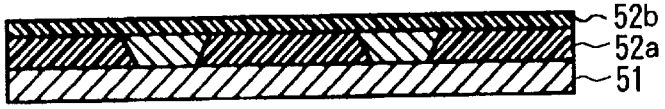
Figure 19:
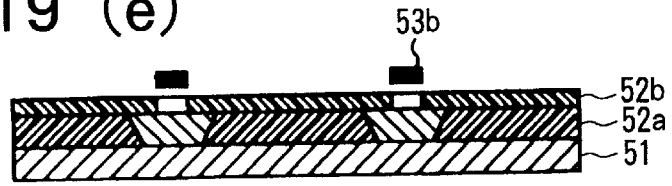
Figure 19:
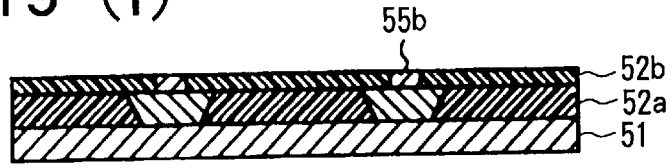
Figure 19:
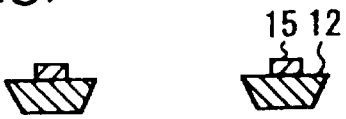

FIG. 19(*a*)–19(*g*) shows the process of providing such a protrusion 15 to the metal wall 12. First, the wall 12 is produced through the steps of FIGS. 19(*a*)–19(*c*) in the manner similar to those of FIGS. 13(*a*)–13(*c*). That is, a resist layer 52*a* of a negative type is first provided over a base metal 51 as shown in FIG. 19(*a*). Then, as shown in FIG. 19(*b*), a mask 53*a* is provided over the photoresist 52*a* at positions where the metal walls 12 are desired to be formed. The photoresist 52*a* is then exposed to light through the mask 53*a*. During the exposure process, due to diffraction action of light, the photoresist 52*a* is selectively exposed to light into a shape whose area gradually increases in a direction that the light travels as shown in FIG. 19(*b*). Accordingly, the remaining non-light-exposed portion has its area gradually decreasing in a direction toward the base metal 51. Then, the non-light-exposed photoresist portion 52*a* is removed from the surface of the base metal 51, and a metal layer 55*a* is electrodeposited on the exposed surface of the base metal 51 as shown in FIG. 19(*c*). As a result, the metal layer 55*a* is formed in a shape whose area gradually increases in a direction away from the base metal 51.

Then, another negative type resist 52*b* is formed over the metal layer 55*a* and the photoresist 52*a* as shown in FIG. 19(*d*). Another mask 53*b* is provided over the resist 52*b* at regions where the protrusion 15 is desired to be formed. Then, the resist 52*b* is exposed to light through the mask 53*b* as shown in FIG. 19(*e*). The non-light-exposed portion of the resist 52*b* is removed from the surface of the metal layer 55*a*. Another metal layer 55*b* is then electrodeposited over the exposed surface of the metal layer 55*a* as shown in FIG. 19(*f*). Then, the resists layers 52*a* and 52*b* are removed from the base metal 51. The combined metal layers 55*a* and 55*b* are released from the base metal 51. As a result, the metal wall 12 having the protrusion 15 is obtained.

Figure 20:
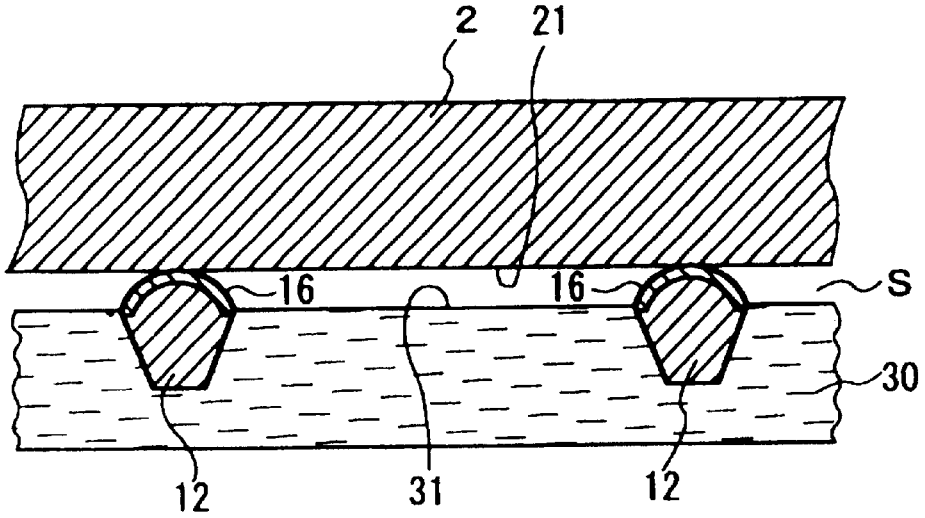
FIG. 20 is a schematical view of a part of a liquid developer according to still another modification, wherein a water-repellent coat is provided to a part of the developer retainer.

According to still another modification, as shown in FIG. 20, a water-repellent coat layer 16 is provided on at least a part of the outer surface 14 of the metal wall 12. By thus providing the water-repellent coat layer 16, it is ensured to prevent the liquid developer 30 from reaching the outer surface 14 of the developer retainer 3. It is possible to more stably maintain the position of the outer liquid surface 31 relative to the position of the photosensitive drum surface 21. In addition, by thus improving the water-repellent property of the metal wall 12, liquid developer 30 will easily move to the photosensitive drum surface 21. The developer retainer 3 is unlikely contaminated. Changes in the contact angle due to contamination can therefore be prevented. Liquid developer 30 can be retained at a stable level.

Anti-corrosion property of the developer retainer 3 can be enhanced by depositing a noble metal layer onto the entire surface of the developer retainer 3 through a metal plating process. More specifically, when each wall 12 is plated with a noble metal layer, the wall 12 will not be corroded by liquid developer 30 or the like, but will stably maintain its proper shape. The water-repellent property of the developer retainer 3 will not change in time due to any undesirable corrosion, and therefore the liquid level will not change in time because there will not generate any changes in the contact angle in time. It will be possible to retain the liquid developer 30 at a stable position.

Preferred examples of the noble metal used include gold. However, other noble metal, such as platinum and palladium, can be used because they have high anti-corrosion property.

Figure 21:
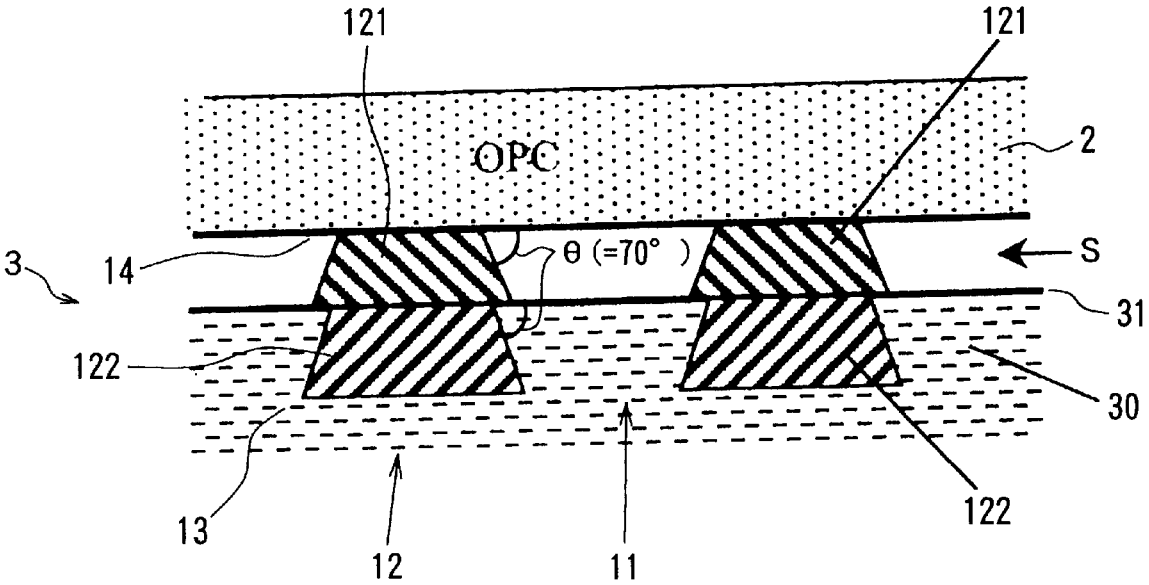
FIG. 21 is a schematical view of a part of a liquid developer according to a further modification, wherein each wall of the developer retainer is comprised from outer and inner portions presenting different contact angles.

According to still another modification, as shown in FIG. 21, each metal wall 12 is comprised from two portions: an outer portion 121 defining the outer surface 14; and an inner portion 122 defining the inner surface 13. The outer portion 121 is made of water repellent material, while the inner portion 122 being made of hydrophilic material. Difference in wettability is thus created between the outer portion 121 and the inner portion 122. More specifically, the outer portion 121 is made of material whose contact angle G1 is greater than the contact angle G2 of the material forming the inner portion 122. For example, the outer portion 121 may be made of polyimide, silicone coat material, fluorine coat material, or the like. Polyimide has the contact angle of about 80 degrees with respect to the liquid developer 30. Silicone coat material and fluorine coat material have the contact angle in a range of 90 degrees to 110 degrees with respect to the liquid developer 30. The inner portion 122 may be made of nickel, copper, or the like. Nickel has the contact angle of about 60 degrees with respect to the liquid developer. Copper has the contact angle of about 60 degrees or less with respect to the liquid developer.

Figure 22:
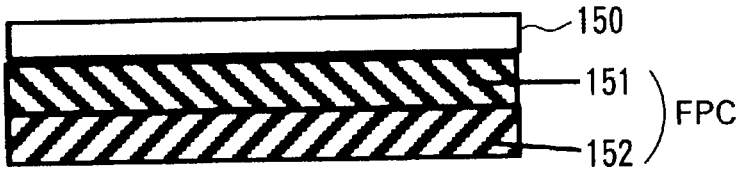
FIGS. 22(*a*)–22(*e*) are process diagrams showing the processes for producing the developer retainer of FIG. 21.
Figure 22:
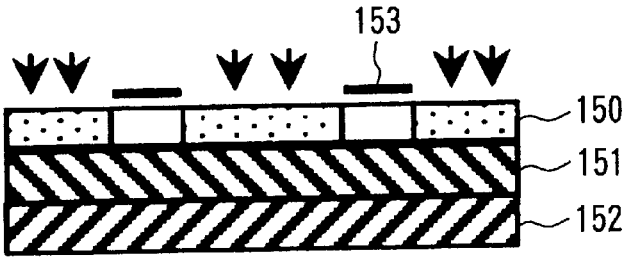
Figure 22:
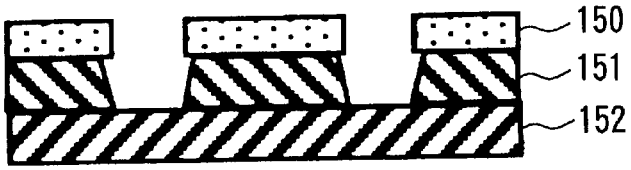
Figure 22:
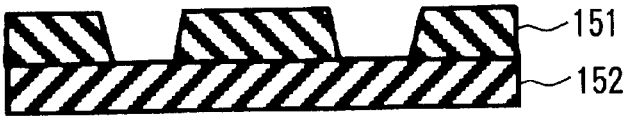
Figure 22:
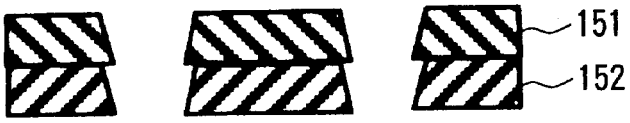

According to this modification, the outer portion 121 and the inner portion 122 are preferably produced through an etching process (FIGS. 22(*a*)–22(*e*)) to have slanted surfaces as shown in FIG. 21. More specifically, the slanted surfaces in both of the outer and inner portions 121 and 122 have the same slanted angle θ of about 70 degrees with respect to the cross-sectional plane of the through-hole 11. This amount of angle θ is greater than the contact angle G2 (about 60 degrees or less) of the inner portion 122, but is smaller than the contact angle G1 (about 80 degrees or more) of the outer portion 121. Accordingly, the liquid developer 30 can advance along the slanted surface of the inner portion 122 until its outer liquid surface 31 reaches the outermost end of the inner portion 122. The liquid developer 30, however, may not advance along the slanted surface of the outer portion 121. As a result, the outer liquid surface 31 of the liquid developer 30 is properly maintained at the boundary between the inner portion 122 and the outer portion 121 as shown in FIG. 21.

It is noted that the slanted angles θ for the outer and inner portions 121 and 122 can be different from each other. It is sufficient that the slanted angle θ for the outer portion 121 be smaller than the contact angle G1 of the outer portion 121 and that the slanted angle θ for the inner portion 122 be greater than the contact angle G2 of the outer portion 122. With this surface configuration, the outer liquid surface 31 can be properly maintained at the boundary between the inner portion 122 and the outer portion 121.

This type of wall 12 can be produced through an etching process shown in FIGS. 22(*a*)–22(*e*), for example. In this example, polyimide is selected as the material forming the outer portion 121 and copper is selected as the material forming the inner portion 122. First, as shown in FIG. 22(*a*), polyimide 151 is provided over the copper plate 152, and a negative type photoresist 150 is provided over the polyimide 151. Then, the photoresist 150 is selectively exposed to light through a mask 153 as shown in FIG. 22(*b*). The polyimide 151 is etched as shown in FIG. 22(*c*). Thereafter, the resist 150 is removed as shown in FIG. 22(*d*). Next, as shown in FIG. 22(*e*), the copper 152 is selectively etched using the polyimide 151 as a mask. During the above-described etching process, the outer and inner portions 121 and 122 are produced to have their slanted surfaces through a side etching operation.

In this modification, the developer retainer 3 has a greater contact angle at its outer surface 14 than at the inner surface 12. Due to this difference in the contact angles, the outer liquid level 31 of the liquid developer 30 is maintained stable, and the liquid developer 30 can easily move to the latent image 21.

Figure 23:
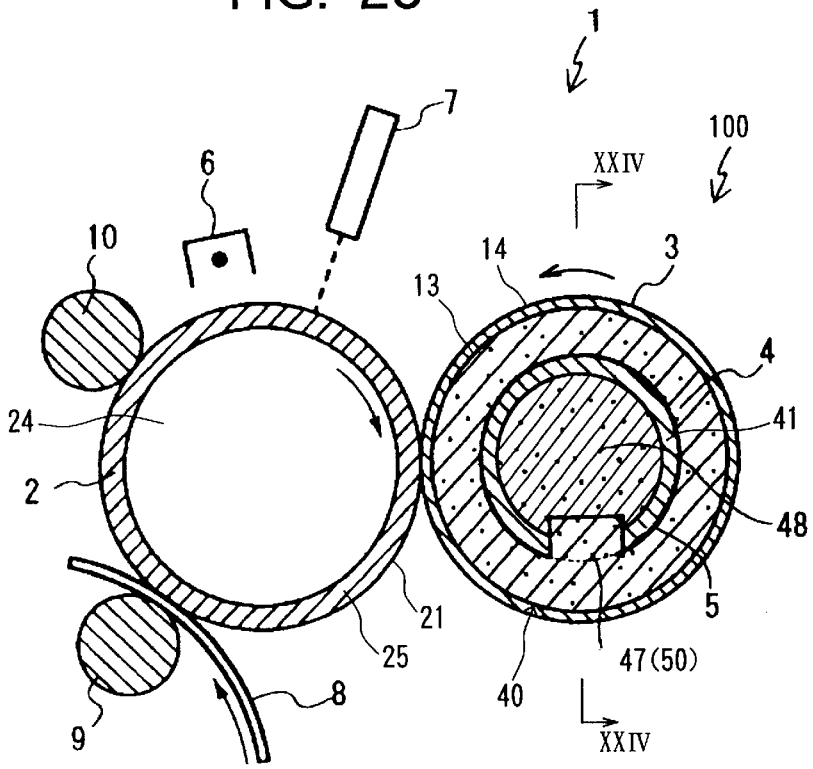
FIG. 23 is a view schematically showing a structure of an image forming apparatus according to another modification.
Figure 24:
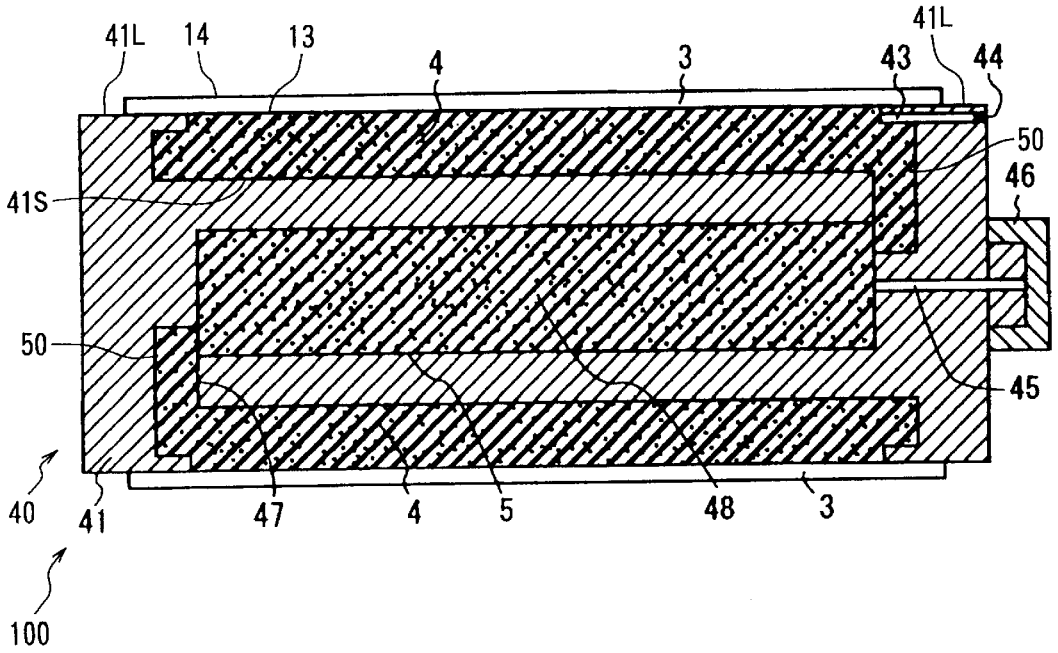
FIG. 24 is a cross-sectional view of a developer supply drum taken along a line XXIV—XXIV of FIG. 23.
Figure 25:
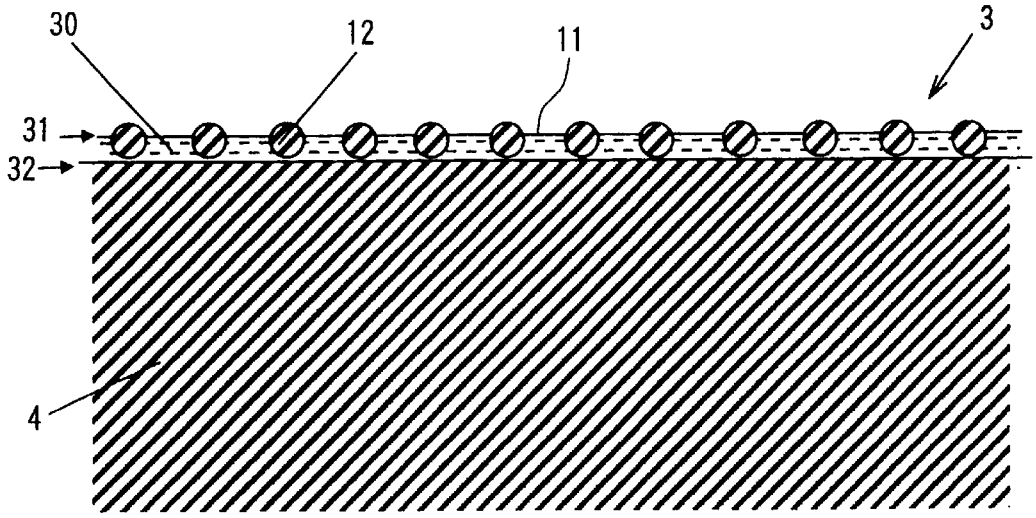
FIG. 25 schematically illustrates the state how liquid developer is retained in the developer retainer in the developer supply drum of FIG. 24.

In the above-described embodiment, the developer retainer 3 is located close to but out of contact with the developer supply porous member 4 as shown in FIG. 1. However, the developer retainer 3 may be located in contact with the developer supply porous member 4 as shown in FIG. 23. In this case, the developer supply porous member 4 is attached to the core 41 in a manner shown in FIG. 24. That is, the developer supply porous member 4 has a greater thickness than that of FIG. 2(*c*). In other words, the developer supply porous member 4 has the thickness equal to the difference between the diameters of the larger diameter portion 41L and of the small diameter portions 41S. Accordingly, when the developer retainer 3 is attached to the larger diameter portions 41L, the developer retainer 3 is brought into contact with the developer supply porous member 4 that is fitted to the small diameter portion 41S. Also in this case, the inner surface level 32 of the liquid developer 30 is positioned as shown in FIG. 25 at the interface between the developer supply porous member 4 and the liquid developer 30, to thereby entirely cover the inner surface 13 of the developer retainer 3. More specifically, the diameter of the pores formed in the developer supply porous member 4 is generally greater than the thickness of the developer retainer 3. For example, the diameter of the pores in the developer supply porous member 4 is generally in a range of about several hundred micrometers to several millimeters. The thickness of the developer retainer 3 is about 20 micrometers. Additionally, the developer retainer 3 is in gently contact with the developer supply porous member 4. Accordingly, a liquid layer of a small thickness in a range of about several micrometers to about ten micrometers is formed between the developer retainer 3 and the developer supply porous member 4, thereby defining the inner liquid surface 32. On the other hand, the outer liquid surface 31 is positioned according to the same principle as described above for the embodiment where the developer retainer 3 is out of contact with the developer supply porous member 4.

According to this modification, because the developer supply porous member 4 is located in contact with the inner side surface 13 of the developer retainer 3, the developer supply porous member 4 can easily supply liquid developer 30 to the developer retainer 3. The developer supply porous member 4 can also function to absorb any excess amount of liquid developer 30 from the developer retainer 3, thereby preventing leakage of the liquid developer 30 from the outer surface 14 of the developer retainer 3.

Figure 26:
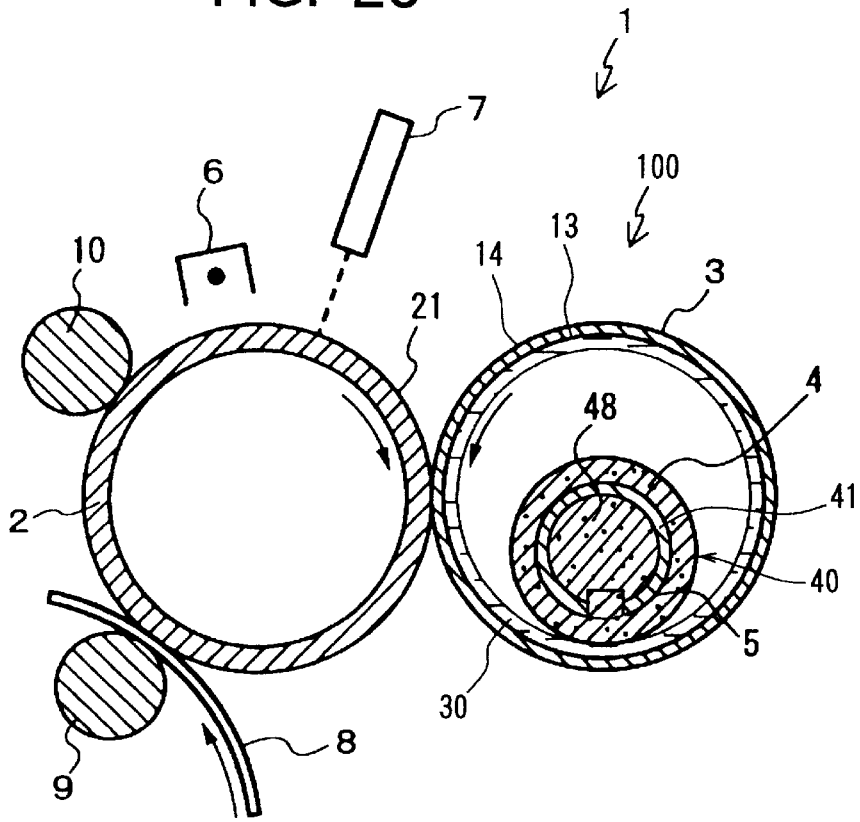
FIG. 26 is a view schematically showing a structure of an image forming apparatus according to still another modification.

According to still another modification, the developer supply drum 100 may be modified as shown in FIG. 26. In the developer supply drum 100 of the above-described embodiment of FIG. 1, the developer supply member 40 is provided confronting the entire portion of the inner peripheral surface 13 of the developer retainer 3. The developer supply porous member 4 is located in close relationship with the entire area of the inner peripheral surface 13 of the developer retainer 3.

Contrarily, according to the present modification, the developer supply member 40 is provided confronting only a predetermined portion of the developer retainer 3. The predetermined portion is shifted from a developing portion where the developer retainer 3 contacts with the photosensitive drum 2. The developer supply drum 40 is positioned so that its developer supply porous member 4 be close to the developer retainer 3 only at the predetermined position. Even with this configuration by supplying a sufficient amount of liquid developer 30 to the developer supply porous member 4 and by rotating the developer supply porous member 4 in the same direction with the developer retainer 3, the liquid developer 30 will sufficiently cover the entire inner side surface of the developer retainer 3 due to its own adhering force, and will be properly retained therein. Because the developer supply porous member 4 is located at the position where the developer retainer 3 does not confront the photosensitive drum 2, no undesirable pressure will be applied to the developing position by the developer supply porous member 4.

While the invention has been described in detail with reference to the specific embodiment thereof, it would be apparent to those skilled in the art that various changes and modifications may be made therein without departing from the spirit of the invention, the scope of which is defined by the attached claims.

What is claimed is:

1. An image forming apparatus for forming images, the apparatus comprising:

an image bearing body having a surface bearing a latent image thereon;

a developer retainer located in confrontation with the image bearing body, the developer retainer having a first surface confronting the image bearing body and a second surface opposed to the first surface, the developer retainer including a number of partition walls for defining a number of through-holes, each partition wall partitioning a corresponding through-hole from its adjacent through-hole, each partition wall extending in a predetermined direction from the second surface to the first surface, thereby allowing the corresponding through-hole to extend in the predetermined direction along the partition wall and to be opened on both of the first and second surfaces, each partition wall having a shape that allows an area of a cross-section of the corresponding through-hole to change along the predetermined direction, the cross-section being defined normal to the predetermined direction; and a developer supply member that supplies a liquid developer to the developer retainer from the second surface, thereby allowing the liquid developer to be held in the developer retainer in a state covering the second surface and to be selectively supplied to the image bearing body via the through-holes to develop the latent image into a visible image.

2. An image forming apparatus as claimed in claim 1, wherein the liquid developer is held in the developer retainer to have a first liquid surface that confronts the image bearing body, the first liquid surface being maintained in the developer retainer at a position that is determined dependently both on the shape of each partition wall and on wettability of the partition wall with respect to the liquid developer.

3. An image forming apparatus as claimed in claim 2, wherein the liquid developer is held in the developer retainer to have a second liquid surface that is opposed to the first liquid surface, the second liquid surface being provided at an interface between the liquid developer and the developer supply member.

4. An image forming apparatus as claimed in claim 1, wherein the image bearing body is made of photoconductive material bearing an electrostatic latent image on its surface, and the liquid developer is electrically conductive, and wherein the developer retainer allows the liquid developer to be selectively attracted electrostatically to the electrostatic latent image via the through-holes to thereby develop the electrostatic latent image into the visible image.

5. An image forming apparatus as claimed in claim 1, wherein each partition wall is shaped so that a hole diameter of a corresponding through-hole changes along the predetermined direction.

6. An image forming apparatus as claimed in claim 1, wherein each partition wall has a surface exposed to the corresponding through-hole, each partition wall having, on its surface, an angle changing portion in which an angle, which is defined between the surface of the partition wall and the cross-section of the corresponding through-hole with respect to a direction opposite to the predetermined direction, decreases along the predetermined direction from a value that is greater than a contact angle toward another value that is smaller than the contact angle, the contact angle being determined dependently on material of the partition wall, the liquid developer being held in the developer retainer with its first liquid surface that confronts the image bearing body being maintained at a position on the surface of each partition wall where the angle is equal to the contact angle.

7. An image forming apparatus as claimed in claim 2, wherein each partition wall has a surface exposed to the corresponding through-hole, each partition wall having, on its surface, an angle changing portion in which an angle, which is defined between the surface of the partition wall and the cross-section of the corresponding through-hole with respect to a direction opposite to the predetermined direction, decreases along the predetermined direction from a value that is greater than a contact angle, which is indicative of the wettability of the surface of the partition wall with respect to the liquid developer, toward another value that is smaller than the contact angle, the first liquid surface of the liquid developer being maintained at a position on the surface of each partition wall where the angle is equal to the contact angle.

8. An image forming apparatus as claimed in claim 7, wherein the surface of each partition wall includes:

a first surface portion that constitutes the first surface;

a second surface portion that constitutes the second surface; and a third surface portion that is positioned between the first and second surface portions and that confronts the corresponding through-hole.

9. An image forming apparatus as claimed in claim 8, wherein the angle changing portion is located within the third surface portion, thereby maintaining the first liquid surface in the through-hole.

10. An image forming apparatus as claimed in claim 8, wherein the angle changing portion is located between the second and third surface portions, thereby maintaining the first liquid surface in the vicinity of an open end of each through-hole on the second surface.

11. An image forming apparatus as claimed in claim 7, wherein the contact angle is equal to a forward contact angle that is defined for the partition wall with respect to the liquid developer.

12. An image forming apparatus as claimed in claim 7, wherein the contact angle is equal to a rearward contact angle that is defined for the partition wall with respect to the liquid developer.

13. An image forming apparatus as claimed in claim 7, wherein the angle changing portion includes an edge portion, at which the angle greatly changes from the value greater than the contact angle, through the contact angle, toward the other value smaller than the contact angle.

14. An image forming apparatus as claimed in claim 13, wherein the surface of each partition wall includes:

a first surface portion that constitutes the first surface;

a second surface portion that constitutes the second surface; and a third surface portion that is provided between the first and second surface portions and that confronts the corresponding through-hole, and wherein the edge portion is located between the second and third surface portions, thereby allowing the first liquid surface to be located in the vicinity of an open end of the through-hole on the second surface.

15. An image forming apparatus as claimed in claim 1, wherein each partition wall is formed with a protrusion on the first surface.

16. An image forming apparatus as claimed in claim 1, wherein the developer retainer is produced through an electroforming process.

17. An image forming apparatus as claimed in claim 1, wherein the developer retainer is produced through an etching process.

18. An image forming apparatus as claimed in claim 1, wherein each partition wall is plated with noble metal.

19. An image forming apparatus as claimed in claim 1, wherein at least a part of the surface of each partition wall is provided with a water-repellent layer.

20. An image forming apparatus as claimed in claim 1, wherein each partition wall includes a first portion that constitutes the first surface and a second portion that constitutes the second surface, the first portion being made of a first material having a first contact angle with respect to the liquid developer, the second portion being made of a second material having a second contact angle with respect to the liquid developer, the first contact angle being greater than the second contact angle.

21. An image forming apparatus as claimed in claim 1, wherein the developer supply member includes a porous member holding the liquid developer therein.

22. An image forming apparatus as claimed in claim 21, wherein the porous member is located in confrontation with the second surface of the developer retainer with a gap being formed therebetween.

23. An image forming apparatus as claimed in claim 21, wherein the porous member is located in contact with the second surface of the developer retainer.

24. An image forming apparatus as claimed in claim 21, wherein the developer retainer is formed in a roll shape, the first surface including an external peripheral surface of the roll shape, the image bearing body being formed in a cylindrical drum shape that is in contact with the first surface of the developer retainer and is rotatable in accordance with a rotation of the developer retainer.

25. An image forming apparatus as claimed in claim 24, wherein the porous member is of a cylindrical shape and is located inside of and concentrically with the roll-shaped developer retainer.

26. An image forming apparatus as claimed in claim 24, wherein the porous member is located inside the roll-shaped developer retainer at a position other than a location where the roll-shaped developer retainer confronts the image bearing body.

27. An image forming apparatus as claimed in claim 21, wherein the developer supply member further includes a developer supply portion that supplies the liquid developer to the porous member.

28. An image forming apparatus as claimed in claim 27, wherein the developer supply portion includes a developer tank located inside the porous member and storing liquid developer therein.

29. An image forming apparatus as claimed in claim 1, wherein the liquid developer is prepared by dissolving or dispersing a coloring component in liquid.

* * * * *